US009022107B2

(12) United States Patent
Agrawal et al.

(10) Patent No.: US 9,022,107 B2
(45) Date of Patent: May 5, 2015

(54) DISSOLVABLE TOOL

(71) Applicants: Gaurav Agrawal, Aurora, CO (US); Zhiyue Xu, Cypress, TX (US)

(72) Inventors: Gaurav Agrawal, Aurora, CO (US); Zhiyue Xu, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/927,761

(22) Filed: Jun. 26, 2013

(65) Prior Publication Data

US 2013/0284425 A1 Oct. 31, 2013

Related U.S. Application Data

(62) Division of application No. 12/633,668, filed on Dec. 8, 2009, now Pat. No. 8,528,633.

(51) Int. Cl.

| | |
|---|---|
| ***E21B 41/00*** | (2006.01) |
| ***E21B 23/00*** | (2006.01) |
| ***E21B 23/04*** | (2006.01) |

(52) U.S. Cl.

CPC ..... *E21B 41/00* (2013.01); *E21B 23/00* (2013.01); *E21B 23/04* (2013.01)

(58) Field of Classification Search

CPC ..... E21B 23/00; E21B 23/04; E21B 33/12; E21B 33/1204; E21B 33/1208; E21B 33/134; E21B 34/063

USPC ..... 166/300, 376, 193, 153; 156/247, 248, 156/701–709; 277/331, 316; 428/576, 559

See application file for complete search history.

(56) References Cited

U.S. PATENT DOCUMENTS

| | | | |
|---|---|---|---|
| 2,238,895 | A | 4/1941 | Gage |
| 2,261,292 | A | 11/1941 | Salnikov |
| 2,301,624 | A | 11/1942 | Holt |
| 2,754,910 | A | 7/1956 | Derrick et al. |
| 2,983,634 | A | 5/1961 | Budininkas et al. |
| 3,057,405 | A | 10/1962 | Mallinger |
| 3,106,959 | A | 10/1963 | Huitt et al. |
| 3,152,009 | A | 10/1964 | DeLong |
| 3,196,949 | A | 7/1965 | Thomas |
| 3,242,988 | A | 3/1966 | McGuire et al. |
| 3,316,748 | A | 5/1967 | Lang et al. |
| 3,326,291 | A | 6/1967 | Zandmer et al. |
| 3,347,317 | A | 10/1967 | Zandmer |

(Continued)

FOREIGN PATENT DOCUMENTS

| | | |
|---|---|---|
| CA | 2783241 A1 | 6/2011 |
| CA | 2783346 A1 | 6/2011 |

(Continued)

OTHER PUBLICATIONS

Constantine, Jesse. "Selective Production of Horizontal Openhole Completions Using ECP and Sliding Sleeve Technology." SPE Rocky Mountain Regional Meeting, May 15-18, 1999, Gillette, Wyoming. [Abstract Only].

(Continued)

*Primary Examiner* — Daniel P Stephenson
(74) *Attorney, Agent, or Firm* — Cantor Colburn LLP

(57) ABSTRACT

A dissolvable tool includes, a body with a surface having at least one perforation therethrough, the at least one perforation being dimensioned to control a rate of intrusion of an environment reactive with at least a portion of the dissolvable tool located below the surface.

20 Claims, 5 Drawing Sheets

(56) References Cited

U.S. PATENT DOCUMENTS 3,390,724 A 7/1968 Caldwell
3,395,758 A 8/1968 Kelly et al.
3,406,101 A 10/1968 Kilpatrick
3,434,537 A 3/1969 Zandmer
3,465,181 A 9/1969 Colby et al.
3,513,230 A 5/1970 Rhees et al.
3,637,446 A 1/1972 Elliott et al.
3,645,331 A 2/1972 Maurer et al.
3,765,484 A 10/1973 Hamby, Jr. et al.
3,768,563 A 10/1973 Blount
3,775,823 A 12/1973 Adolph et al.
3,878,889 A 4/1975 Seabourn
3,894,850 A 7/1975 Kovalchuk et al.
3,924,677 A 12/1975 Prenner et al.
4,010,583 A 3/1977 Highberg
4,039,717 A 8/1977 Titus
4,050,529 A 9/1977 Tagirov et al.
4,157,732 A 6/1979 Fonner
4,248,307 A 2/1981 Silberman et al.
4,372,384 A 2/1983 Kinney
4,373,584 A 2/1983 Silberman et al.
4,374,543 A 2/1983 Richardson
4,384,616 A 5/1983 Dellinger
4,399,871 A 8/1983 Adkins et al.
4,407,368 A 10/1983 Erbstoesser
4,422,508 A 12/1983 Rutledge, Jr. et al.
4,452,311 A 6/1984 Speegle et al.
4,475,729 A 10/1984 Costigan
4,498,543 A 2/1985 Pye et al.
4,499,048 A 2/1985 Hanejko
4,499,049 A 2/1985 Hanejko
4,534,414 A 8/1985 Pringle
4,539,175 A 9/1985 Lichti et al.
4,554,986 A 11/1985 Jones
4,640,354 A 2/1987 Boisson
4,664,962 A 5/1987 DesMarais, Jr.
4,673,549 A 6/1987 Ecer
4,674,572 A 6/1987 Gallus
4,678,037 A 7/1987 Smith
4,681,133 A 7/1987 Weston
4,688,641 A 8/1987 Knieriemen
4,693,863 A 9/1987 Del Corso et al.
4,703,807 A 11/1987 Weston
4,706,753 A 11/1987 Ohkochi et al.
4,708,202 A 11/1987 Sukup et al.
4,708,208 A 11/1987 Halbardier
4,709,761 A 12/1987 Setterberg, Jr.
4,714,116 A 12/1987 Brunner
4,716,964 A 1/1988 Erbstoesser et al.
4,721,159 A 1/1988 Ohkochi et al.
4,738,599 A 4/1988 Shilling
4,741,973 A 5/1988 Condit et al.
4,768,588 A 9/1988 Kupsa
4,784,226 A 11/1988 Wyatt
4,805,699 A 2/1989 Halbardier
4,817,725 A 4/1989 Jenkins
4,834,184 A 5/1989 Streich et al.
H635 H 6/1989 Johnson et al.
4,850,432 A 7/1989 Porter et al.
4,853,056 A 8/1989 Hoffman
4,869,324 A 9/1989 Holder
4,869,325 A 9/1989 Halbardier
4,889,187 A 12/1989 Terrell et al.
4,890,675 A 1/1990 Dew
4,909,320 A 3/1990 Hebert et al.
4,929,415 A 5/1990 Okazaki
4,932,474 A 6/1990 Schroeder, Jr. et al.
4,944,351 A 7/1990 Eriksen et al.
4,949,788 A 8/1990 Szarka et al.
4,952,902 A 8/1990 Kawaguchi et al.
4,975,412 A 12/1990 Okazaki et al.
4,977,958 A 12/1990 Miller
4,981,177 A 1/1991 Carmody et al.
4,986,361 A 1/1991 Mueller et al.
5,006,044 A 4/1991 Walker, Sr. et al.
5,010,955 A 4/1991 Springer
5,036,921 A 8/1991 Pittard et al.
5,048,611 A 9/1991 Cochran
5,049,165 A 9/1991 Tselesin
5,061,323 A 10/1991 DeLuccia
5,063,775 A 11/1991 Walker, Sr. et al.
5,073,207 A 12/1991 Faure et al.
5,074,361 A 12/1991 Brisco et al.
5,076,869 A 12/1991 Bourell et al.
5,084,088 A 1/1992 Okazaki
5,090,480 A 2/1992 Pittard et al.
5,095,988 A 3/1992 Bode
5,103,911 A 4/1992 Heijnen
5,117,915 A 6/1992 Mueller et al.
5,161,614 A 11/1992 Wu et al.
5,178,216 A 1/1993 Giroux et al.
5,181,571 A 1/1993 Mueller et al.
5,188,182 A 2/1993 Echols, III et al.
5,188,183 A 2/1993 Hopmann et al.
5,204,055 A 4/1993 Sachs et al.
5,222,867 A 6/1993 Walker, Sr. et al.
5,226,483 A 7/1993 Williamson, Jr.
5,228,518 A 7/1993 Wilson et al.
5,234,055 A 8/1993 Cornette
5,252,365 A 10/1993 White
5,253,714 A 10/1993 Davis et al.
5,271,468 A 12/1993 Streich et al.
5,282,509 A 2/1994 Schurr, III
5,292,478 A 3/1994 Scorey
5,293,940 A 3/1994 Hromas et al.
5,309,874 A 5/1994 Willermet et al.
5,310,000 A 5/1994 Arterbury et al.
5,318,746 A 6/1994 Lashmore et al.
5,380,473 A 1/1995 Bogue et al.
5,387,380 A 2/1995 Cima et al.
5,392,860 A 2/1995 Ross
5,394,941 A 3/1995 Venditto et al.
5,398,754 A 3/1995 Dinhoble
5,407,011 A 4/1995 Layton
5,411,082 A 5/1995 Kennedy
5,417,285 A 5/1995 Van Buskirk et al.
5,425,424 A 6/1995 Reinhardt et al.
5,427,177 A 6/1995 Jordan, Jr. et al.
5,435,392 A 7/1995 Kennedy
5,439,051 A 8/1995 Kennedy et al.
5,454,430 A 10/1995 Kennedy et al.
5,456,317 A 10/1995 Hood, III et al.
5,456,327 A 10/1995 Denton et al.
5,464,062 A 11/1995 Blizzard, Jr.
5,472,048 A 12/1995 Kennedy et al.
5,474,131 A 12/1995 Jordan, Jr. et al.
5,477,923 A 12/1995 Jordan, Jr. et al.
5,479,986 A 1/1996 Gano et al.
5,507,439 A 4/1996 Story
5,526,880 A 6/1996 Jordan, Jr. et al.
5,526,881 A 6/1996 Martin et al.
5,529,746 A 6/1996 Knoss et al.
5,533,573 A 7/1996 Jordan, Jr. et al.
5,536,485 A 7/1996 Kume et al.
5,558,153 A 9/1996 Holcombe et al.
5,607,017 A 3/1997 Owens et al.
5,623,993 A 4/1997 Van Buskirk et al.
5,623,994 A 4/1997 Robinson
5,636,691 A 6/1997 Hendrickson et al.
5,641,023 A 6/1997 Ross et al.
5,647,444 A 7/1997 Williams
5,665,289 A 9/1997 Chung et al.
5,677,372 A 10/1997 Yamamoto et al.
5,685,372 A 11/1997 Gano
5,701,576 A 12/1997 Fujita et al.
5,707,214 A 1/1998 Schmidt
5,709,269 A 1/1998 Head
5,720,344 A 2/1998 Newman
5,765,639 A 6/1998 Muth
5,772,735 A 6/1998 Sehgal et al.
5,782,305 A 7/1998 Hicks
5,797,454 A 8/1998 Hipp
5,826,652 A 10/1998 Tapp
5,826,661 A 10/1998 Parker et al.

(56) References Cited

U.S. PATENT DOCUMENTS

| | | | |
|---|---|---|---|
| 5,829,520 | A | 11/1998 | Johnson |
| 5,836,396 | A | 11/1998 | Norman |
| 5,857,521 | A | 1/1999 | Ross et al. |
| 5,881,816 | A | 3/1999 | Wright |
| 5,934,372 | A | 8/1999 | Muth |
| 5,941,309 | A | 8/1999 | Appleton |
| 5,960,881 | A | 10/1999 | Allamon et al. |
| 5,985,466 | A | 11/1999 | Atarashi et al. |
| 5,990,051 | A | 11/1999 | Ischy et al. |
| 5,992,452 | A | 11/1999 | Nelson, II |
| 5,992,520 | A | 11/1999 | Schultz et al. |
| 6,007,314 | A | 12/1999 | Nelson, II |
| 6,024,915 | A | 2/2000 | Kume et al. |
| 6,032,735 | A | 3/2000 | Echols |
| 6,036,777 | A | 3/2000 | Sachs |
| 6,047,773 | A | 4/2000 | Zeltmann et al. |
| 6,050,340 | A | 4/2000 | Scott |
| 6,069,313 | A | 5/2000 | Kay |
| 6,076,600 | A | 6/2000 | Vick, Jr. et al. |
| 6,079,496 | A | 6/2000 | Hirth |
| 6,085,837 | A | 7/2000 | Massinon et al. |
| 6,095,247 | A | 8/2000 | Streich et al. |
| 6,119,783 | A | 9/2000 | Parker et al. |
| 6,142,237 | A | 11/2000 | Christmas et al. |
| 6,161,622 | A | 12/2000 | Robb et al. |
| 6,167,970 | B1 | 1/2001 | Stout et al. |
| 6,173,779 | B1 | 1/2001 | Smith |
| 6,189,616 | B1 | 2/2001 | Gano et al. |
| 6,189,618 | B1 | 2/2001 | Beeman et al. |
| 6,213,202 | B1 | 4/2001 | Read, Jr. |
| 6,220,350 | B1 | 4/2001 | Brothers et al. |
| 6,220,357 | B1 | 4/2001 | Carmichael |
| 6,228,904 | B1 | 5/2001 | Yadav et al. |
| 6,237,688 | B1 | 5/2001 | Burleson et al. |
| 6,238,280 | B1 | 5/2001 | Ritt et al. |
| 6,241,021 | B1 | 6/2001 | Bowling |
| 6,250,392 | B1 | 6/2001 | Muth |
| 6,261,432 | B1 | 7/2001 | Huber et al. |
| 6,273,187 | B1 | 8/2001 | Voisin, Jr. et al. |
| 6,276,452 | B1 | 8/2001 | Davis et al. |
| 6,276,457 | B1 | 8/2001 | Moffatt et al. |
| 6,279,656 | B1 | 8/2001 | Sinclair et al. |
| 6,287,445 | B1 | 9/2001 | Lashmore et al. |
| 6,302,205 | B1 | 10/2001 | Ryll |
| 6,315,041 | B1 | 11/2001 | Carlisle et al. |
| 6,315,050 | B2 | 11/2001 | Vaynshteyn et al. |
| 6,325,148 | B1 | 12/2001 | Trahan et al. |
| 6,328,110 | B1 | 12/2001 | Joubert |
| 6,341,653 | B1 | 1/2002 | Firmaniuk et al. |
| 6,341,747 | B1 | 1/2002 | Schmidt et al. |
| 6,349,766 | B1 | 2/2002 | Bussear et al. |
| 6,354,379 | B2 | 3/2002 | Miszewski et al. |
| 6,371,206 | B1 | 4/2002 | Mills |
| 6,372,346 | B1 | 4/2002 | Toth |
| 6,382,244 | B2 | 5/2002 | Vann |
| 6,390,195 | B1 | 5/2002 | Nguyen et al. |
| 6,390,200 | B1 | 5/2002 | Allamon et al. |
| 6,394,185 | B1 | 5/2002 | Constien |
| 6,397,950 | B1 | 6/2002 | Streich et al. |
| 6,403,210 | B1 | 6/2002 | Stuivinga et al. |
| 6,408,946 | B1 | 6/2002 | Marshall et al. |
| 6,419,023 | B1 | 7/2002 | George et al. |
| 6,439,313 | B1 | 8/2002 | Thomeer et al. |
| 6,457,525 | B1 | 10/2002 | Scott |
| 6,467,546 | B2 | 10/2002 | Allamon et al. |
| 6,470,965 | B1 | 10/2002 | Winzer |
| 6,491,097 | B1 | 12/2002 | ONeal et al. |
| 6,491,116 | B2 | 12/2002 | Berscheidt et al. |
| 6,513,598 | B2 | 2/2003 | Moore et al. |
| 6,540,033 | B1 | 4/2003 | Sullivan et al. |
| 6,543,543 | B2 | 4/2003 | Muth |
| 6,561,275 | B2 | 5/2003 | Glass et al. |
| 6,588,507 | B2 | 7/2003 | Dusterhoft et al. |
| 6,591,915 | B2 | 7/2003 | Burris et al. |
| 6,601,648 | B2 | 8/2003 | Ebinger |
| 6,601,650 | B2 | 8/2003 | Sundararajan |
| 6,609,569 | B2 | 8/2003 | Howlett et al. |
| 6,612,826 | B1 | 9/2003 | Bauer et al. |
| 6,613,383 | B1 | 9/2003 | George et al. |
| 6,619,400 | B2 | 9/2003 | Brunet |
| 6,634,428 | B2 | 10/2003 | Krauss et al. |
| 6,662,886 | B2 | 12/2003 | Russell |
| 6,675,889 | B1 | 1/2004 | Mullins et al. |
| 6,713,177 | B2 | 3/2004 | George et al. |
| 6,715,541 | B2 | 4/2004 | Pedersen et al. |
| 6,719,051 | B2 | 4/2004 | Hailey, Jr. et al. |
| 6,755,249 | B2 | 6/2004 | Robison et al. |
| 6,776,228 | B2 | 8/2004 | Pedersen et al. |
| 6,779,599 | B2 | 8/2004 | Mullins et al. |
| 6,799,638 | B2 | 10/2004 | Butterfield, Jr. |
| 6,810,960 | B2 | 11/2004 | Pia |
| 6,817,414 | B2 | 11/2004 | Lee |
| 6,831,044 | B2 | 12/2004 | Constien |
| 6,883,611 | B2 | 4/2005 | Smith et al. |
| 6,887,297 | B2 | 5/2005 | Winter et al. |
| 6,896,049 | B2 | 5/2005 | Moyes |
| 6,896,061 | B2 | 5/2005 | Hriscu et al. |
| 6,899,176 | B2 | 5/2005 | Hailey, Jr. et al. |
| 6,913,827 | B2 | 7/2005 | George et al. |
| 6,926,086 | B2 | 8/2005 | Patterson et al. |
| 6,932,159 | B2 | 8/2005 | Hovem |
| 6,939,388 | B2 | 9/2005 | Angeliu |
| 6,945,331 | B2 | 9/2005 | Patel |
| 6,959,759 | B2 | 11/2005 | Doane et al. |
| 6,973,970 | B2 | 12/2005 | Johnston et al. |
| 6,973,973 | B2 | 12/2005 | Howard et al. |
| 6,983,796 | B2 | 1/2006 | Bayne et al. |
| 6,986,390 | B2 | 1/2006 | Doane et al. |
| 7,013,989 | B2 | 3/2006 | Hammond et al. |
| 7,013,998 | B2 | 3/2006 | Ray et al. |
| 7,017,664 | B2 | 3/2006 | Walker et al. |
| 7,017,677 | B2 | 3/2006 | Keshavan et al. |
| 7,021,389 | B2 | 4/2006 | Bishop et al. |
| 7,025,146 | B2 | 4/2006 | King et al. |
| 7,028,778 | B2 | 4/2006 | Krywitsky |
| 7,044,230 | B2 | 5/2006 | Starr et al. |
| 7,049,272 | B2 | 5/2006 | Sinclair et al. |
| 7,051,805 | B2 | 5/2006 | Doane et al. |
| 7,059,410 | B2 | 6/2006 | Bousche et al. |
| 7,090,027 | B1 | 8/2006 | Williams |
| 7,093,664 | B2 | 8/2006 | Todd et al. |
| 7,096,945 | B2 | 8/2006 | Richards et al. |
| 7,096,946 | B2 | 8/2006 | Jasser et al. |
| 7,097,906 | B2 | 8/2006 | Gardner |
| 7,108,080 | B2 | 9/2006 | Tessari et al. |
| 7,111,682 | B2 | 9/2006 | Blaisdell |
| 7,141,207 | B2 | 11/2006 | Jandeska, Jr. et al. |
| 7,150,326 | B2 | 12/2006 | Bishop et al. |
| 7,163,066 | B2 | 1/2007 | Lehr |
| 7,168,494 | B2 | 1/2007 | Starr et al. |
| 7,174,963 | B2 | 2/2007 | Bertelsen |
| 7,182,135 | B2 | 2/2007 | Szarka |
| 7,210,527 | B2 | 5/2007 | Walker et al. |
| 7,210,533 | B2 | 5/2007 | Starr et al. |
| 7,217,311 | B2 | 5/2007 | Hong et al. |
| 7,234,530 | B2 | 6/2007 | Gass |
| 7,250,188 | B2 | 7/2007 | Dodelet et al. |
| 7,252,162 | B2 | 8/2007 | Akinlade et al. |
| 7,255,172 | B2 | 8/2007 | Johnson |
| 7,255,178 | B2 | 8/2007 | Slup et al. |
| 7,264,060 | B2 | 9/2007 | Wills |
| 7,267,172 | B2 | 9/2007 | Hofman |
| 7,267,178 | B2 | 9/2007 | Krywitsky |
| 7,270,186 | B2 | 9/2007 | Johnson |
| 7,287,592 | B2 | 10/2007 | Surjaatmadja et al. |
| 7,311,152 | B2 | 12/2007 | Howard et al. |
| 7,316,274 | B2 | 1/2008 | Xu et al. |
| 7,320,365 | B2 | 1/2008 | Pia |
| 7,322,412 | B2 | 1/2008 | Badalamenti et al. |
| 7,322,417 | B2 | 1/2008 | Rytlewski et al. |
| 7,325,617 | B2 | 2/2008 | Murray |
| 7,328,750 | B2 | 2/2008 | Swor et al. |
| 7,331,388 | B2 | 2/2008 | Vilela et al. |
| 7,337,854 | B2 | 3/2008 | Horn et al. |

(56) References Cited

U.S. PATENT DOCUMENTS

| | | | |
|---|---|---|---|
| 7,346,456 | B2 | 3/2008 | Le Bemadjiel |
| 7,350,582 | B2 | 4/2008 | McKeachnie et al. |
| 7,353,879 | B2 | 4/2008 | Todd et al. |
| 7,360,593 | B2 | 4/2008 | Constien |
| 7,360,597 | B2 | 4/2008 | Blaisdell |
| 7,363,970 | B2 | 4/2008 | Corre et al. |
| 7,384,443 | B2 | 6/2008 | Mirchandani |
| 7,387,158 | B2 | 6/2008 | Murray et al. |
| 7,387,165 | B2 | 6/2008 | Lopez de Cardenas et al. |
| 7,392,841 | B2 | 7/2008 | Murray et al. |
| 7,401,648 | B2 | 7/2008 | Richard |
| 7,416,029 | B2 | 8/2008 | Telfer et al. |
| 7,422,058 | B2 | 9/2008 | O'Malley |
| 7,426,964 | B2 | 9/2008 | Lynde et al. |
| 7,441,596 | B2 | 10/2008 | Wood et al. |
| 7,445,049 | B2 | 11/2008 | Howard et al. |
| 7,451,815 | B2 | 11/2008 | Hailey, Jr. |
| 7,451,817 | B2 | 11/2008 | Reddy et al. |
| 7,461,699 | B2 | 12/2008 | Richard et al. |
| 7,464,764 | B2 | 12/2008 | Xu |
| 7,472,750 | B2 | 1/2009 | Walker et al. |
| 7,478,676 | B2 | 1/2009 | East, Jr. et al. |
| 7,503,390 | B2 | 3/2009 | Gomez |
| 7,503,399 | B2 | 3/2009 | Badalamenti et al. |
| 7,509,993 | B1 | 3/2009 | Turng et al. |
| 7,510,018 | B2 | 3/2009 | Williamson et al. |
| 7,513,311 | B2 | 4/2009 | Gramstad et al. |
| 7,527,103 | B2 | 5/2009 | Huang et al. |
| 7,537,825 | B1 | 5/2009 | Wardle et al. |
| 7,552,777 | B2 | 6/2009 | Murray et al. |
| 7,552,779 | B2 | 6/2009 | Murray |
| 7,559,357 | B2 | 7/2009 | Clem |
| 7,575,062 | B2 | 8/2009 | East, Jr. |
| 7,579,087 | B2 | 8/2009 | Maloney et al. |
| 7,591,318 | B2 | 9/2009 | Tilghman |
| 7,600,572 | B2 | 10/2009 | Slup et al. |
| 7,604,049 | B2 | 10/2009 | Vaidya et al. |
| 7,604,055 | B2 | 10/2009 | Richard et al. |
| 7,617,871 | B2 | 11/2009 | Surjaatmadja et al. |
| 7,635,023 | B2 | 12/2009 | Goldberg et al. |
| 7,640,988 | B2 | 1/2010 | Phi et al. |
| 7,661,480 | B2 | 2/2010 | Al-Anazi |
| 7,661,481 | B2 | 2/2010 | Todd et al. |
| 7,665,537 | B2 | 2/2010 | Patel et al. |
| 7,686,082 | B2 | 3/2010 | Marsh |
| 7,690,436 | B2 | 4/2010 | Turley et al. |
| 7,699,101 | B2 | 4/2010 | Fripp et al. |
| 7,703,511 | B2 | 4/2010 | Buyers et al. |
| 7,708,078 | B2 | 5/2010 | Stoesz |
| 7,709,421 | B2 | 5/2010 | Jones et al. |
| 7,712,541 | B2 | 5/2010 | Loretz et al. |
| 7,723,272 | B2 | 5/2010 | Crews et al. |
| 7,726,406 | B2 | 6/2010 | Xu |
| 7,735,578 | B2 | 6/2010 | Loehr et al. |
| 7,752,971 | B2 | 7/2010 | Loehr |
| 7,757,773 | B2 | 7/2010 | Rytlewski |
| 7,762,342 | B2 | 7/2010 | Richard et al. |
| 7,770,652 | B2 | 8/2010 | Barnett |
| 7,775,284 | B2 | 8/2010 | Richards et al. |
| 7,775,285 | B2 | 8/2010 | Surjaatmadja et al. |
| 7,775,286 | B2 | 8/2010 | Duphorne |
| 7,784,543 | B2 | 8/2010 | Johnson |
| 7,793,714 | B2 | 9/2010 | Johnson |
| 7,798,225 | B2 | 9/2010 | Giroux et al. |
| 7,798,226 | B2 | 9/2010 | Themig |
| 7,798,236 | B2 | 9/2010 | McKeachnie et al. |
| 7,806,189 | B2 | 10/2010 | Frazier |
| 7,806,192 | B2 | 10/2010 | Foster et al. |
| 7,810,553 | B2 | 10/2010 | Cruickshank et al. |
| 7,810,567 | B2 | 10/2010 | Daniels et al. |
| 7,819,198 | B2 | 10/2010 | Birckhead et al. |
| 7,828,055 | B2 | 11/2010 | Willauer et al. |
| 7,833,944 | B2 | 11/2010 | Munoz et al. |
| 7,849,927 | B2 | 12/2010 | Herrera |
| 7,855,168 | B2 | 12/2010 | Fuller et al. |
| 7,861,781 | B2 | 1/2011 | D'Arcy |
| 7,874,365 | B2 | 1/2011 | East, Jr. et al. |
| 7,878,253 | B2 | 2/2011 | Stowe et al. |
| 7,896,091 | B2 | 3/2011 | Williamson et al. |
| 7,897,063 | B1 | 3/2011 | Perry et al. |
| 7,900,696 | B1 | 3/2011 | Nish et al. |
| 7,900,703 | B2 | 3/2011 | Clark et al. |
| 7,909,096 | B2 | 3/2011 | Clark et al. |
| 7,909,104 | B2 | 3/2011 | Bjorgum |
| 7,909,110 | B2 | 3/2011 | Sharma et al. |
| 7,909,115 | B2 | 3/2011 | Grove et al. |
| 7,913,765 | B2 | 3/2011 | Crow et al. |
| 7,931,093 | B2 | 4/2011 | Foster et al. |
| 7,938,191 | B2 | 5/2011 | Vaidya |
| 7,946,340 | B2 | 5/2011 | Surjaatmadja et al. |
| 7,958,940 | B2 | 6/2011 | Jameson |
| 7,963,331 | B2 | 6/2011 | Surjaatmadja et al. |
| 7,963,340 | B2 | 6/2011 | Gramstad et al. |
| 7,963,342 | B2 | 6/2011 | George |
| 7,980,300 | B2 | 7/2011 | Roberts et al. |
| 7,987,906 | B1 | 8/2011 | Troy |
| 8,020,619 | B1 | 9/2011 | Robertson et al. |
| 8,020,620 | B2 | 9/2011 | Daniels et al. |
| 8,025,104 | B2 | 9/2011 | Cooke, Jr. |
| 8,028,767 | B2 | 10/2011 | Radford et al. |
| 8,033,331 | B2 | 10/2011 | Themig |
| 8,039,422 | B1 | 10/2011 | Al-Zahrani |
| 8,056,628 | B2 | 11/2011 | Whitsitt et al. |
| 8,056,638 | B2 | 11/2011 | Clayton et al. |
| 8,109,340 | B2 | 2/2012 | Doane et al. |
| 8,127,856 | B1 * | 3/2012 | Nish et al. ..... 166/376 |
| 8,163,060 | B2 | 4/2012 | Imanishi et al. |
| 8,211,247 | B2 | 7/2012 | Marya et al. |
| 8,211,248 | B2 | 7/2012 | Marya |
| 8,226,740 | B2 | 7/2012 | Chaumonnot et al. |
| 8,231,947 | B2 | 7/2012 | Vaidya et al. |
| 8,276,670 | B2 | 10/2012 | Patel |
| 8,297,364 | B2 | 10/2012 | Agrawal et al. |
| 8,327,931 | B2 | 12/2012 | Agrawal et al. |
| 8,403,037 | B2 | 3/2013 | Agrawal et al. |
| 8,425,651 | B2 | 4/2013 | Xu et al. |
| 8,528,633 | B2 * | 9/2013 | Agrawal et al. ..... 166/193 |
| 8,567,494 | B2 * | 10/2013 | Rytlewski et al. ..... 166/250.01 |
| 8,573,295 | B2 * | 11/2013 | Johnson et al. ..... 166/193 |
| 8,631,876 | B2 * | 1/2014 | Xu et al. ..... 166/376 |
| 2001/0045285 | A1 | 11/2001 | Russell |
| 2001/0045288 | A1 | 11/2001 | Allamon et al. |
| 2002/0000319 | A1 | 1/2002 | Brunet |
| 2002/0007948 | A1 | 1/2002 | Bayne et al. |
| 2002/0014268 | A1 | 2/2002 | Vann |
| 2002/0066572 | A1 | 6/2002 | Muth |
| 2002/0104616 | A1 | 8/2002 | De et al. |
| 2002/0136904 | A1 | 9/2002 | Glass et al. |
| 2002/0162661 | A1 | 11/2002 | Krauss et al. |
| 2003/0037925 | A1 | 2/2003 | Walker et al. |
| 2003/0060374 | A1 | 3/2003 | Cooke, Jr. |
| 2003/0075326 | A1 | 4/2003 | Ebinger |
| 2003/0104147 | A1 | 6/2003 | Bretschneider et al. |
| 2003/0111728 | A1 | 6/2003 | Thai et al. |
| 2003/0141060 | A1 | 7/2003 | Hailey et al. |
| 2003/0141061 | A1 | 7/2003 | Hailey et al. |
| 2003/0141079 | A1 | 7/2003 | Doane et al. |
| 2003/0150614 | A1 | 8/2003 | Brown et al. |
| 2003/0155114 | A1 | 8/2003 | Pedersen et al. |
| 2003/0155115 | A1 | 8/2003 | Pedersen et al. |
| 2003/0159828 | A1 | 8/2003 | Howard et al. |
| 2003/0164237 | A1 | 9/2003 | Butterfield |
| 2003/0183391 | A1 | 10/2003 | Hriscu et al. |
| 2004/0005483 | A1 | 1/2004 | Lin |
| 2004/0020832 | A1 | 2/2004 | Richards et al. |
| 2004/0045723 | A1 | 3/2004 | Slup et al. |
| 2004/0089449 | A1 | 5/2004 | Walton et al. |
| 2004/0154806 | A1 | 8/2004 | Bode et al. |
| 2004/0159428 | A1 | 8/2004 | Hammond et al. |
| 2004/0182583 | A1 | 9/2004 | Doane et al. |
| 2004/0231845 | A1 | 11/2004 | Cooke |
| 2004/0256109 | A1 | 12/2004 | Johnson |
| 2004/0256157 | A1 | 12/2004 | Tessari et al. |
| 2004/0261993 | A1 | 12/2004 | Nguyen |

(56) References Cited

U.S. PATENT DOCUMENTS

| | | | |
|---|---|---|---|
| 2005/0034876 | A1 | 2/2005 | Doane et al. |
| 2005/0051329 | A1 | 3/2005 | Blaisdell |
| 2005/0069449 | A1 | 3/2005 | Jackson et al. |
| 2005/0102255 | A1 | 5/2005 | Bultman |
| 2005/0126334 | A1 | 6/2005 | Mirchandani |
| 2005/0161212 | A1 | 7/2005 | Leismer et al. |
| 2005/0161224 | A1 | 7/2005 | Starr et al. |
| 2005/0165149 | A1 | 7/2005 | Chanak et al. |
| 2005/0194143 | A1 | 9/2005 | Xu et al. |
| 2005/0205264 | A1 | 9/2005 | Starr et al. |
| 2005/0205265 | A1 | 9/2005 | Todd et al. |
| 2005/0205266 | A1 | 9/2005 | Todd et al. |
| 2005/0241824 | A1 | 11/2005 | Burris, II et al. |
| 2005/0241825 | A1 | 11/2005 | Burris, II et al. |
| 2005/0257936 | A1 | 11/2005 | Lehr |
| 2005/0279501 | A1 | 12/2005 | Surjaatmadja et al. |
| 2006/0012087 | A1 | 1/2006 | Matsuda et al. |
| 2006/0045787 | A1 | 3/2006 | Jandeska et al. |
| 2006/0057479 | A1 | 3/2006 | Niimi et al. |
| 2006/0081378 | A1 | 4/2006 | Howard et al. |
| 2006/0102871 | A1 | 5/2006 | Wang et al. |
| 2006/0108114 | A1 | 5/2006 | Johnson et al. |
| 2006/0108126 | A1 | 5/2006 | Horn et al. |
| 2006/0110615 | A1 | 5/2006 | Karim et al. |
| 2006/0116696 | A1 | 6/2006 | Odermatt et al. |
| 2006/0124310 | A1 | 6/2006 | Lopez de Cardenas |
| 2006/0124312 | A1 | 6/2006 | Rytlewski et al. |
| 2006/0131011 | A1 | 6/2006 | Lynde et al. |
| 2006/0131031 | A1 | 6/2006 | McKeachnie et al. |
| 2006/0131081 | A1 | 6/2006 | Mirchandani et al. |
| 2006/0144515 | A1 | 7/2006 | Tada et al. |
| 2006/0150770 | A1 | 7/2006 | Freim et al. |
| 2006/0151178 | A1 | 7/2006 | Howard et al. |
| 2006/0162927 | A1 | 7/2006 | Walker et al. |
| 2006/0169453 | A1 | 8/2006 | Savery et al. |
| 2006/0207763 | A1 | 9/2006 | Hofman |
| 2006/0213670 | A1 | 9/2006 | Bishop et al. |
| 2006/0231253 | A1 | 10/2006 | Vilela et al. |
| 2006/0283592 | A1 | 12/2006 | Sierra et al. |
| 2007/0017674 | A1 | 1/2007 | Blaisdell |
| 2007/0017675 | A1 | 1/2007 | Hammami et al. |
| 2007/0029082 | A1 | 2/2007 | Giroux et al. |
| 2007/0039741 | A1 | 2/2007 | Hailey |
| 2007/0044958 | A1 | 3/2007 | Rytlewski et al. |
| 2007/0044966 | A1 | 3/2007 | Davies et al. |
| 2007/0051521 | A1 | 3/2007 | Fike et al. |
| 2007/0053785 | A1 | 3/2007 | Hetz et al. |
| 2007/0054101 | A1 | 3/2007 | Sigalas et al. |
| 2007/0057415 | A1 | 3/2007 | Katagiri et al. |
| 2007/0062644 | A1 | 3/2007 | Nakamura et al. |
| 2007/0074601 | A1 | 4/2007 | Hong et al. |
| 2007/0074873 | A1 | 4/2007 | McKeachnie et al. |
| 2007/0102199 | A1 | 5/2007 | Smith et al. |
| 2007/0107908 | A1 | 5/2007 | Vaidya et al. |
| 2007/0108060 | A1 | 5/2007 | Park |
| 2007/0119600 | A1 | 5/2007 | Slup et al. |
| 2007/0131912 | A1 | 6/2007 | Simone et al. |
| 2007/0151009 | A1 | 7/2007 | Conrad, III et al. |
| 2007/0151769 | A1 | 7/2007 | Slutz et al. |
| 2007/0169935 | A1 | 7/2007 | Akbar et al. |
| 2007/0181224 | A1 | 8/2007 | Marya et al. |
| 2007/0185655 | A1 | 8/2007 | Le Bemadjiel |
| 2007/0187095 | A1 | 8/2007 | Walker et al. |
| 2007/0221373 | A1 | 9/2007 | Murray |
| 2007/0221384 | A1 | 9/2007 | Murray |
| 2007/0259994 | A1 | 11/2007 | Tour et al. |
| 2007/0261862 | A1 | 11/2007 | Murray |
| 2007/0272411 | A1 | 11/2007 | Lopez De Cardenas et al. |
| 2007/0272413 | A1 | 11/2007 | Rytlewski et al. |
| 2007/0277979 | A1 | 12/2007 | Todd et al. |
| 2007/0284109 | A1 | 12/2007 | East et al. |
| 2007/0299510 | A1 | 12/2007 | Venkatraman et al. |
| 2008/0020923 | A1 | 1/2008 | Debe et al. |
| 2008/0047707 | A1 | 2/2008 | Boney et al. |
| 2008/0060810 | A9 | 3/2008 | Nguyen et al. |
| 2008/0066923 | A1 | 3/2008 | Xu |
| 2008/0066924 | A1 | 3/2008 | Xu |
| 2008/0072705 | A1 | 3/2008 | Chaumonnot et al. |
| 2008/0078553 | A1 | 4/2008 | George |
| 2008/0081866 | A1 | 4/2008 | Gong et al. |
| 2008/0099209 | A1 | 5/2008 | Loretz et al. |
| 2008/0105438 | A1 | 5/2008 | Jordan et al. |
| 2008/0115932 | A1 | 5/2008 | Cooke |
| 2008/0121390 | A1 | 5/2008 | O'Malley et al. |
| 2008/0121436 | A1 | 5/2008 | Slay et al. |
| 2008/0127475 | A1 | 6/2008 | Griffo |
| 2008/0135249 | A1 | 6/2008 | Fripp et al. |
| 2008/0149325 | A1 | 6/2008 | Crawford |
| 2008/0149345 | A1 | 6/2008 | Marya et al. |
| 2008/0149351 | A1 | 6/2008 | Marya et al. |
| 2008/0169105 | A1 | 7/2008 | Williamson et al. |
| 2008/0179060 | A1 | 7/2008 | Surjaatmadja et al. |
| 2008/0179104 | A1 | 7/2008 | Zhang et al. |
| 2008/0202764 | A1 | 8/2008 | Clayton et al. |
| 2008/0202814 | A1 | 8/2008 | Lyons et al. |
| 2008/0210473 | A1 | 9/2008 | Zhang et al. |
| 2008/0216383 | A1 | 9/2008 | Pierick et al. |
| 2008/0223586 | A1 | 9/2008 | Barnett |
| 2008/0223587 | A1 | 9/2008 | Cherewyk |
| 2008/0236829 | A1 | 10/2008 | Lynde |
| 2008/0248205 | A1 | 10/2008 | Blanchet et al. |
| 2008/0277109 | A1 | 11/2008 | Vaidya |
| 2008/0277980 | A1 | 11/2008 | Koda et al. |
| 2008/0282924 | A1 | 11/2008 | Saenger et al. |
| 2008/0296024 | A1 | 12/2008 | Huang et al. |
| 2008/0314581 | A1 | 12/2008 | Brown |
| 2008/0314588 | A1 | 12/2008 | Langlais et al. |
| 2009/0038858 | A1 | 2/2009 | Griffo et al. |
| 2009/0044946 | A1 | 2/2009 | Schasteen et al. |
| 2009/0044949 | A1 | 2/2009 | King et al. |
| 2009/0050334 | A1 | 2/2009 | Marya et al. |
| 2009/0056934 | A1 | 3/2009 | Xu |
| 2009/0084553 | A1 | 4/2009 | Rytlewski et al. |
| 2009/0084556 | A1 | 4/2009 | Richards et al. |
| 2009/0084600 | A1 | 4/2009 | Severance |
| 2009/0107684 | A1 | 4/2009 | Cooke, Jr. |
| 2009/0114381 | A1 | 5/2009 | Stroobants |
| 2009/0114382 | A1 | 5/2009 | Grove et al. |
| 2009/0145666 | A1 | 6/2009 | Radford et al. |
| 2009/0151949 | A1 | 6/2009 | Marya et al. |
| 2009/0152009 | A1 | 6/2009 | Slay et al. |
| 2009/0159289 | A1 | 6/2009 | Avant et al. |
| 2009/0178808 | A1 | 7/2009 | Williamson et al. |
| 2009/0194273 | A1 | 8/2009 | Surjaatmadja et al. |
| 2009/0205841 | A1 | 8/2009 | Kluge et al. |
| 2009/0226340 | A1 | 9/2009 | Marya |
| 2009/0226704 | A1 | 9/2009 | Kauppinen et al. |
| 2009/0242202 | A1 | 10/2009 | Rispler et al. |
| 2009/0242208 | A1 | 10/2009 | Bolding |
| 2009/0242214 | A1 | 10/2009 | Foster et al. |
| 2009/0255667 | A1 | 10/2009 | Clem et al. |
| 2009/0255684 | A1 | 10/2009 | Bolding |
| 2009/0255686 | A1 | 10/2009 | Richard et al. |
| 2009/0260817 | A1 | 10/2009 | Gambier et al. |
| 2009/0266548 | A1 | 10/2009 | Olsen et al. |
| 2009/0272544 | A1 | 11/2009 | Giroux et al. |
| 2009/0283270 | A1 | 11/2009 | Langeslag |
| 2009/0293672 | A1 | 12/2009 | Mirchandani et al. |
| 2009/0301730 | A1 | 12/2009 | Gweily |
| 2009/0308588 | A1 | 12/2009 | Howell et al. |
| 2009/0317556 | A1 | 12/2009 | Macary |
| 2010/0003536 | A1 | 1/2010 | Smith et al. |
| 2010/0012385 | A1 | 1/2010 | Drivdahl et al. |
| 2010/0015002 | A1 | 1/2010 | Barrera et al. |
| 2010/0025255 | A1 | 2/2010 | Su et al. |
| 2010/0032151 | A1 | 2/2010 | Duphorne |
| 2010/0044041 | A1 | 2/2010 | Smith et al. |
| 2010/0051278 | A1 | 3/2010 | Mytopher et al. |
| 2010/0055492 | A1 | 3/2010 | Barsoum et al. |
| 2010/0089583 | A1 | 4/2010 | Xu et al. |
| 2010/0089587 | A1 | 4/2010 | Stout |
| 2010/0101803 | A1 | 4/2010 | Clayton et al. |
| 2010/0122817 | A1 | 5/2010 | Surjaatmadja et al. |
| 2010/0139930 | A1 | 6/2010 | Patel et al. |

(56) References Cited

U.S. PATENT DOCUMENTS

| | | | | |
|---|---|---|---|---|
| 2010/0200230 | A1 | 8/2010 | East, Jr. et al. | |
| 2010/0236793 | A1 | 9/2010 | Bjorgum | |
| 2010/0236794 | A1 | 9/2010 | Duan et al. | |
| 2010/0243254 | A1 | 9/2010 | Murphy et al. | |
| 2010/0252273 | A1 | 10/2010 | Duphorne | |
| 2010/0252280 | A1 | 10/2010 | Swor et al. | |
| 2010/0270031 | A1 | 10/2010 | Patel | |
| 2010/0276136 | A1 | 11/2010 | Evans et al. | |
| 2010/0282338 | A1 | 11/2010 | Gerrard et al. | |
| 2010/0282469 | A1 | 11/2010 | Richard et al. | |
| 2010/0294510 | A1 | 11/2010 | Holmes | |
| 2011/0005773 | A1 | 1/2011 | Dusterhoft et al. | |
| 2011/0036592 | A1 | 2/2011 | Fay | |
| 2011/0048743 | A1 | 3/2011 | Stafford et al. | |
| 2011/0056692 | A1 | 3/2011 | Lopez de Cardenas et al. | |
| 2011/0056702 | A1 | 3/2011 | Sharma et al. | |
| 2011/0067872 | A1 | 3/2011 | Agrawal | |
| 2011/0067889 | A1 | 3/2011 | Marya et al. | |
| 2011/0067890 | A1 | 3/2011 | Themig | |
| 2011/0094406 | A1 | 4/2011 | Marya et al. | |
| 2011/0100643 | A1 | 5/2011 | Themig et al. | |
| 2011/0127044 | A1 | 6/2011 | Radford et al. | |
| 2011/0132143 | A1 | 6/2011 | Xu et al. | |
| 2011/0132612 | A1 | 6/2011 | Agrawal et al. | |
| 2011/0132619 | A1 | 6/2011 | Agrawal et al. | |
| 2011/0132620 | A1 | 6/2011 | Agrawal et al. | |
| 2011/0132621 | A1 | 6/2011 | Agrawal et al. | |
| 2011/0135530 | A1 | 6/2011 | Xu et al. | |
| 2011/0135805 | A1 | 6/2011 | Doucet et al. | |
| 2011/0135953 | A1 | 6/2011 | Xu et al. | |
| 2011/0136707 | A1 | 6/2011 | Xu et al. | |
| 2011/0139465 | A1 | 6/2011 | Tibbles et al. | |
| 2011/0147014 | A1 | 6/2011 | Chen et al. | |
| 2011/0186306 | A1 | 8/2011 | Marya et al. | |
| 2011/0214881 | A1 | 9/2011 | Newton et al. | |
| 2011/0247833 | A1 | 10/2011 | Todd et al. | |
| 2011/0253387 | A1 | 10/2011 | Ervin | |
| 2011/0256356 | A1 | 10/2011 | Tomantschger et al. | |
| 2011/0259610 | A1 | 10/2011 | Shkurti et al. | |
| 2011/0277987 | A1 | 11/2011 | Frazier | |
| 2011/0277989 | A1 | 11/2011 | Frazier | |
| 2011/0284232 | A1 | 11/2011 | Huang | |
| 2011/0284240 | A1 | 11/2011 | Chen et al. | |
| 2011/0284243 | A1 | 11/2011 | Frazier | |
| 2012/0067426 | A1 | 3/2012 | Soni et al. | |
| 2012/0103135 | A1 | 5/2012 | Xu et al. | |
| 2012/0107590 | A1 | 5/2012 | Xu et al. | |
| 2012/0118583 | A1 | 5/2012 | Johnson et al. | |
| 2012/0130470 | A1 | 5/2012 | Agnew et al. | |
| 2012/0168152 | A1 | 7/2012 | Casciaro | |
| 2012/0211239 | A1 | 8/2012 | Kritzler et al. | |
| 2012/0292053 | A1 | 11/2012 | Xu et al. | |
| 2012/0318513 | A1 | 12/2012 | Mazyar et al. | |
| 2013/0025409 | A1 | 1/2013 | Xu | |
| 2013/0032357 | A1 | 2/2013 | Mazyar et al. | |
| 2013/0048304 | A1 | 2/2013 | Agrawal et al. | |
| 2013/0052472 | A1 | 2/2013 | Xu | |
| 2013/0081814 | A1 | 4/2013 | Gaudette et al. | |
| 2013/0105159 | A1 | 5/2013 | Alvarez et al. | |
| 2013/0126190 | A1 | 5/2013 | Mazyar et al. | |
| 2013/0133897 | A1 | 5/2013 | Baihly et al. | |
| 2013/0146144 | A1 | 6/2013 | Joseph et al. | |
| 2013/0146302 | A1 | 6/2013 | Gaudette et al. | |
| 2013/0160992 | A1* | 6/2013 | Agrawal et al. | 166/193 |
| 2013/0186626 | A1 | 7/2013 | Aitken et al. | |
| 2013/0284425 | A1* | 10/2013 | Agrawal et al. | 166/193 |
| 2013/0327540 | A1 | 12/2013 | Hamid et al. | |
| 2014/0116711 | A1 | 5/2014 | Tang et al. | |

FOREIGN PATENT DOCUMENTS

| | | | |
|---|---|---|---|
| CN | 1076968 | A | 10/1993 |
| CN | 1255879 | A | 6/2000 |
| CN | 101050417 | A | 10/2007 |
| CN | 101351523 | A1 | 1/2009 |
| CN | 101457321 | B | 6/2009 |
| EP | 1798301 | A1 | 8/2006 |
| EP | 1857570 | A1 | 11/2007 |
| GB | 912956 | | 12/1962 |
| JP | 61067770 | | 4/1986 |
| JP | 754008 | | 2/1995 |
| JP | 754008 | A | 2/1995 |
| JP | 8232029 | A1 | 10/1996 |
| JP | 2000185725 | | 7/2000 |
| JP | 2004225084 | | 8/2004 |
| JP | 2004225765 | A | 8/2004 |
| JP | 2005076052 | A | 3/2005 |
| JP | 2010502840 | A | 1/2010 |
| KR | 950014350 | | 11/1995 |
| WO | 9947726 | | 9/1999 |
| WO | 2008057045 | A1 | 5/2008 |
| WO | 2008079777 | A3 | 7/2008 |
| WO | WO2008079485 | | 7/2008 |
| WO | 2009079745 | A1 | 7/2009 |
| WO | 2011071902 | A2 | 6/2011 |
| WO | 2011071910 | A3 | 6/2011 |
| WO | 2012174101 | A2 | 12/2012 |

OTHER PUBLICATIONS

Elsayed Ayman, Imai Hisashi, Umeda Junko and Kondoh Katsuyoshi, "Effect of Consolidation and Extrusion Temperatures on Tensile Properties of Hot Extruded ZK61 Magnesium Alloy Gas Atomized Powders via Spark Plasma Sintering" Transacation of JWRI, vol. 38, (2009) No. 2, pp. 31-35.

H. Watarai, Trend of research and development for magnesium alloys-reducing the weight of structural materials in motor vehicles, (2006) Science and technology trends, Quaterly review No. 18, 84-97.

Bing Q. Han, Enrique J. Lavernia and Farghalli A. Mohamed, "Mechanical Properties of Nanostructured Materials", Rev. Adv. Mater. Sci. 9(2005) 1-16.

M. Bououdina, Z. X. Guo, Comparative study of mechanical alloying of (Mg+Al) and (Mg+Al+Ni) mixtures for hydrogen storage, J. Alloys, Compds, 2002, 336, 222-231.

M.Liu, P.J. Uggowitzer, A.V. Nagasekhar, P. Schmutz, M. Easton, G.L. Song, A. Atrens, Calculated phase diagrams and the corrosion of die-cast Mg—Al alloys, Corrosion Science, 2009, 51, 606-619.

Adam J. Maisano, "Cryomilling of Aluminum-Based and Magnesium-Based Metal Powders", Thesis, Virginia Tech, Jan. 13, 2006.

International Search Report and Written Opinion, International Application No. PCT/US2012/049434, Date of Mailing Feb. 1, 2013, Korean Intellectual Property Office, Written Opinion 4 pages, International Search Report 3 pages.

E.J. Lavenia, B.Q. Han, J.M. Schoenung: "Cryomilled nanostructured materials: Processing and properties", Materials Science and Engineering A, 493, (2008) 207-214.

International Search Report and Written Opinion; PCT/US2012/038622; Dated Dec. 6, 2012; 12 pages.

S.L. Lee, C.W. Hsu, F.K. Hsu, C.Y. Chou, C.k. Lin, C.W. Weng, Effects of Ni addition on hydrogen storage properties of Mg17AL12alloy, Materials Chemistry and Physics, 2011, 126, 319-324.

Shumbera et al. "Improved Water Injector Performance in a Gulf of Mexico Deepwater Development Using an Openhole Frac Pack Completion and Downhole Filter System: Case History." SPE Annual Technical Conference and Exhibition, Oct. 5-8, 2003, Denver, Colorado. [Abstract Only].

T.J. Bastow, S. Celotto, Clustering and formation of nano-precipitates in dilute aluminum and magnesium alloys, Materials science and Engineering, 2003, C23, 757-762.

Vickery, Harold and Christian Bayne, "New One-Trip Multi-Zone Frac Pack System with Positive Positioning." European Petroleum Conference, Oct. 29-31, 2002, Aberdeen, UK. [Abstract Only].

H. Watanabe, T. Mukai, M. Mabuchi and K. Higashi, "Superplastic Deformation Mechanism in Powder Metallurgy Magnesium Alloys and Composites", Acta mater. 49 (2001) pp. 2027-2037.

(56) References Cited

OTHER PUBLICATIONS

Baker Oil Tools. "Z-Seal Metal-to-Metal Expandable Sealing Device Uses Expanding Metal in Place of Elastomers," Nov. 6, 2006.
Constantin Vahlas, Bri Gitte Caussat, Philippe Serp, George N. Angelopoulos, "Principles and Applications of CVD Powder Technology", Materials Sciene and Engineering R 53 (2006) 1-72.
Curtin, William and Brian Sheldon. "CNT-reinforced ceramics and metals," Materials Today, 2004, vol. 7, 44-49.
Yi Feng, Hailong Yuan, "Electroless Plating of Carbon Nanotubes with Silver" Journal fo Materials Science, 39, (2004) pp. 3241-3243.
Guan Ling Song, Andrej Atrens "Corrosion Mechanisms of Magnesium Alloys", Advanced Engineering Materials 1999, 1, No. 1, pp. 11-33.
Hjortstam et al. "Can we achieve ultra-low resistivity in carbon nanotube-based metal composites," Applied Physics A (2004), vol. 78, Issue 8, pp. 1175-1179. [Abstract Only].
Notification of Transmittal of the International Search Report and the Written Opinion of the International Searching Authority; PCT/US2010/059259; International Searching Authority KIPO; Mailed Jun. 13, 2010.
J. Dutta Majumdar, B. Ramesh Chandra, B.L. Mordike, R. Galun, I. Manna, "Laser Surface Engineering of a Magnesium Alloy with Al + A12O3", Surface and Cotaings Technology 179 (2004) 297-305.
J.E. Gray, B. Luan, "Protective Coatings on Magnesuim and Its Alloys—a Critical Review", Journal of Alloys and Compounds 336 (2002) 88-113.
Stephen P. Mathis, "Sand Management: A Review of Approaches and Concerns"; Society of Petroleum Engineers, SPE Paper No. 82240; SPE European Formation Damage Conference, The Hague, The Netherlands, May 13-14, 2003.
Nie, Xiaowu. "Patents of Methods to Prepare Intermetallic Matrix Composites: A Review," Recent Patents on Materials Science 2008, vol. 1, pp. 232-240.
Shimizu et al., "Multi-walled carbon nanotube-reinforced magnesium alloy composites", Scripta Materialia, vol. 58, Issue 4, pp. 267-270.
Song, G. and S. Song. "A Possible Biodegradable Magnesium Implant Material," Advanced Engineering Materials, vol. 9, Issue 4, Apr. 2007, pp. 298-302. [Abstract Only].
Song, et al.; "Understanding Magnesium Corrosion"; Advanced Engineering Materials; 5; No. 12; pp. 837-858; (2003).
Zeng et al. "Progress and Challenge for Magnesium Alloys as Biomaterials," Advanced Engineering Materials, vol. 10, Issue 8, Aug. 2008, pp. B3-B14. [Abstract Only].
International Search Report and Written Opinion for International application No. PCT/US2012/034978 filed on Apr. 25, 2012, mailed on Nov. 29, 2012.
International Search Report and Written Opinion; Mail Date Jul. 28, 2011; Internal Applilcatio No. PCT/US2010/057763; International Filing date Nov. 23, 2010; Korean Intellectual Property Office; International Search Report 7 pages; Written Opinion 3 pages.
Ambat, et al.; "Electroless Nickel-Plating on AZ91D Magnesium Alloy: Effect of Substrate Microstructure and Plating Parameters"; Surface and Coatings Technology; 179; pp. 124-134; (2004).
Chang, et al.; "Electrodeposition of Aluminum on Magnesium Alloy in Aluminum Chloride (A1C13)-1-ethy1-3-methylimidazolium chloride (EMIC) Ionic Liquid and Its Corrosion Behavior"; Electrochemistry Communications; 9; pp. 1602-1606; (2007).
Chun-Lin, Li. "Design of Abrasive Water Jet Perforation and Hydraulic Fracturing Tool," Oil Field Equipment, Mar. 2011.
Forsyth, et al.; "An Ionic Liquid Surface Treatment for Corrosion Protection of Magnesium Alloy AZ31"; Electrochem. Solid-State Lett./ 9(11); Abstract only; 1 page.
Forsyth, et al.; "Exploring Corrosion Protection of Mg Via Ionic Liquid Pretreatment"; Surface & Coatings Technology; 201; pp. 4496-4504; (2007).
Hsiao et al.; "Effect of Heat Treatment on Anodization and Electrochemical Behavior of AZ91D Magnesium Alloy"; J. Mater. Res.; 20(10); pp. 2763-2771;(2005).
Hsiao, et al.; "Anodization of AZ91D Magnesium Alloy in Silicate-Containing Electrolytes"; Surface & Coatings Technology; 199; pp. 127-134; (2005).
Hsiao, et al.; "Baking Treatment Effect on Materials Characteristics and Electrochemical Behavior of anodic Film Formed on AZ91D Magnesium Alloy"; Corrosion Science; 49; pp. 781-793; (2007).
Hsiao, et al.; "Characterization of Anodic Films Formed on AZ91D Magnesium Alloy"; Surface & Coatings Technology; 190; pp. 299-308; (2005).
Huo et al.; "Corrosion of AZ91D Magnesium Alloy with a Chemical Conversion Coating and Electroless Nickel Layer"; Corrosion Science: 46; pp. 1467-1477; (2004).
Liu, et al.; "Electroless Nickel Plating on AZ91 Mg Alloy Substrate"; Surface & Coatings Technology; 200; pp. 5087-5093; (2006).
Lunder et al.; "The Role of Mg17Al12 Phase in the Corrosion of Mg Alloy AZ91"; Corrosion; 45(9); pp. 741-748; (1989).
Notification of Transmittal of the International Search Report and the Written Opinion of the International Searching Authority; PCT/US2011/047000; Korean Intellectual Property Office; Mailed Dec. 26, 2011; 8 pages.
Shi et al.; "Influence of the Beta Phase on the Corrosion Performance of Anodised Coatings on Magnesium-Aluminium Alloys"; Corrosion Science; 47; pp. 2760-2777; (2005).
Song, et al.; "Corrosion Behaviour of AZ21, AZ501 and AZ91 in Sodium Chloride"; Corrosion Science; 40(10); pp. 1769-1791; (1998).
Song, et al.; "Corrosion Mechanisms of Magnesium Alloys"; Advanced Engineering Materials; 1(1); pp. 11-33; (1999).
Song, et al.; "Influence of Microstructure on the Corrosion of Diecast AZ91D"; Corrosion Science; 41; pp. 249-273; (1999).
Song, Guangling; "Recent Progress in Corrosion and Protection of Magnesium Alloys"; Advanced Engineering Materials; 7(7); pp. 563-586; (2005).
Wikipedia, the free encyclopedia. Reactivity series. http://en.wikipedia.org/w/index.php?title=Reactivity_series&printable=yes downloaded on May 18, 2014. 8 pages.
Xiaowu Nie, Patents of Methods to Prepare Intermetallic Matrix Composites: A Review, Recent Patents on Materials Science 2008, 1, 232-240, Department of Scientific Research, Hunan Railway College of Science and Technology, Zhuzhou, P.R. China.
Zhang, et al; "Study on the Environmentally Friendly Anodizing of AZ91D Magnesium Alloy"; Surface and Coatings Technology: 161; pp. 36-43; (2002).
"Sliding Sleeve", Omega Completion Technology Ltd, Sep. 29, 2009, retrieved on: www.omega-completion.com.
Abdoulaye Seyni, Nadine Le Bolay, Sonia Molina-Boisseau, "On the interest of using degradable fillers in co-ground composite materials", Powder Technology 190, (2009) pp. 176-184.
Baker Hughes Tools. "Baker Oil Tools Introduces Revolutionary Sand Control Completion Technology," May 2, 2005.
Bybee, Karen. "One-Trip Completion System Eliminates Perforations," Completions Today, Sep. 2007, pp. 52-53.
C.S. Goh, J. Wei, L C Lee, and M. Gupta, "Development of novel carbon nanotube reinforced magnesium nanocomposites using the powder metallurgy technique", Nanottechnology 17 (2006) 7-12.
CH. Christoglou, N. Voudouris, G.N. Angelopoulos, M. Pant, W. Dahl, "Deposition of Aluminum on Magnesium by a CVD Process", Surface and Coatings Technology 184 (2004) 149-155.
CN Office Action dated Jul. 3, 2014; CN Patent application No. 201180012447.5; 7 pages.
W. Walters, P. Peregino, R. Summers, and D. Leidel; "A Study of Jets from Unsintered-Powder Metal Lined Nonprecision Small-Caliber Shaped Charges", Army Research Laboratory, Aberdeen Proving Ground, MD 21005-5066; Feb. 2001.
E. Flahaut et al., "Carbon Nanotube-Metal-Oxide Nanocomposites: Microstructure, Electrical Conductivity and Mechanical Properties" Acta amter. 48 (2000) 3803-3812.
E. Paul Bercegeay et al., "A One-Trip Gravel Packing System"; Society of Petroleum Engineers, Offshort Technology Conference, SPE Paper No. 4771; Feb. 7-8, 1974.

(56) References Cited

OTHER PUBLICATIONS

Flow Control Systems, [online]; [retrieved on May 20, 2010]; retrieved from the Internet http://www.bakerhughes.com/products-and-services/completions-and-productions/well-completions/packers-and-flow-control/flow-control-systems.
G. Song, et al., "Understanding Magnesium Corrosion", Advanced Engineering Materials, 5, No. 12, pp. 837-858, (2003).
Galanty et al. "Consolidation of metal powders during the extrusion process," Journal of Materials Processing Technology (2002), pp. 491-496.
Garfield G., Baker Hughes Incoporated, New One-Trip Sand-Control Completion System that Eliminates Formation Damage Resulting From conventional Perforating and Gravel-Packing Operations:, SPE Annual Technical Conference and Exhibition, Oct. Sep. 9-12, 2005.
Guo-Dong Zhan, Joshua D. Kuntz, Julin Wan and Amiya K. Mukherjee, "Single-wall carbon nanotubes as attractive toughening agents in alumina-based nanocomposites" Nature Materials, vol. 2., Jan. 2003. 38-42.
H. Hermawan, H. Alamdari, D. Mantovani and Dominique Dube, "Iron-manganese: new class of metallic degradable biomaterials prepared by powder metallurgy", Powder Metallurgy, vol. 51, No. 1, (2008), pp. 38-45.
Hjortstam et al. "Can we achieve ultra-low resistivity in carbon nanotube-based metal composites," Applied Physics A (2004), vol. 78, Issue 8, pp. 1175-1179.
International Search Report and Written Opinion for PCT Application No. PCT/US2010/059259, Jun. 13, 2011, pp. 1-8.
International Search Report and Written Opinion for PCT Application No. PCT/US2012/044866, dated Jan. 2, 2013, pp. 1-9.
International Search Report and Written Opinion for PCT Application No. PCT/US2012/049434, Feb. 1, 2013, pp. 1-7.
International Search Report and Written Opinion of the International Searching Authority for International Application No. PCT/US2011/058099 (filed on Oct. 27, 2011), mailed on May 11, 2012.
International Search Report and Written Opinion of the International Searching Authority, or the Declaration for PCT/US2011/058105 mailed from the Korean Intellectual Property Office on May 1, 2012.
International Search Report and Written Opinion of the International Searching Authority mailed on Feb. 19, 2013, for International Application No. PCT/US2012/053342 filed on Aug. 31, 2012.
International Search Report and Written Opinion, PCT/US2012/046231, Date of Mailing Jan. 29, 2013, Korean Intellectual Property Office, Written Opinion 6 pages, International Search Report 3 pages.
International Search Report and Written Opinion; International Application No. PCT/US2012/038622; International Filing Date: May 18, 2012; Date of Mailing Dec. 6, 2012; 12 pages.
International Search Report and Written Opinion; Mail Date Jul. 28, 2011; Internal Applilcatio No. PCT/US2010/057763; International Filing date Nov. 23, 2010; Korean Intellectual Property Office; International Search Report 7 pages; Written Opinion 3.
J. Dutta Majumdar, B. Ramesh Chandra, B.L. Mordike, R. Galun, I. Manna, "Laser Surface Engineering of a Magnesium Alloy with Al + Al2O3", Surface and Cotaings Technology 179 (2004) 297-305.
Jing Sun, Lian Gao, Wei Li, "Colloidal Processing fo Carbon Nanotube/Alumina Composites" Chem. Mater. 2002, 14, 5169-5172.
Joel Shaw, "Benefits and Application of a Surface-Controlled Sliding Sleeve for Fracturing Operations"; Society of Petroleum Engineers, SPE Paper No. 147546; Oct. 30, 2011; 8 pages.
N. Birbilis, et al., "Exploring Corrosion Protection of Mg Via Ionic Liquid Pretreatment", Surface & Coatings Technology; 201, pp. 4496-4504, (2007).
N. Carrejo et al., "Improving Flow Assurance in Multi-Zone Fracturing Treatments in Hydrocarben Reservoirs with High Strength Corrodible Tripping Balls"; Society of Petroleum Engineers; SPE Paper No. 151613; Apr. 16, 2012; 6 pages.
Notification of Transmittal of the International Search Report and the Written Opinion of the International Searching Authority, or the Declaration mailed on Feb. 23, 2012 (Dated Feb. 22, 2012) for PCT/US2011/043036.
Notification of Transmittal of the International Search Report and the Written Opinion of the International Searching Authority; PCT/US2010/059257; Korean Intellectual Property Office; Mailed Jul. 27, 2011.
Notification of Transmittal of the International Search Report and the Written Opinion of the International Searching Authority; PCT/US2010/059265; International Searching Authority KIPO; Mailed Jun. 16, 2011.
Notification of Transmittal of the International Search Report and the Written Opinion of the International Searching Authority; PCT/US2010/059268; International Searching Authority KIPO; Mailed Jun. 17, 2011.
Notification of Transmittal of the International Search Report and the Written Opinion of the International Searching Authority; PCT/US2014/054720; Mailed Dec. 17, 2014; Korean Intellecutual Property Office; 10 pages.
Notification of Transmittal of the International Search Report and Written Opinion, Mailed Jul. 8, 2011, International Appln. No. PCT/US2010/059263, Written Opinion 4 Pages, International Search Report 3 Pages.
Optisleeve Sliding Sleeve, [online]; [retrieved on Jun. 25, 2010]; retrieved from the Internet weatherford.com/weatherford/groups/.../weatherfordcorp/WFT033159.pdf.
Pardo, et al.; "Corrosion Behaviour of Magnesium/Aluminium Alloys in 3.5 wt% NaC1"; Corrosion Science; 50; pp. 823-834; (2008).
Patent Cooperation Treaty International Search Report and Written Opinion for International Patent Application No. PCT/US2012/034978 filed on Apr. 25, 2012, mailed on Nov. 12, 2012.
S. Mathis, "Sand Management: A Review of Approaches and Concerns", Society of Petroleum Engineers, SPE Paper No. 82240, SPE European Formation Damage Conference, The Hague, The Netherlands, May 13-14, 2003.
Toru Kuzumaki, Osamu Ujiie, Hideki Ichinose, and Kunio Ito, "Mechanical Characteristics and Preparation of Carbon Nanotube Fiber-Reinforced Ti Composite", Advanced Engineering Materials, 2000, 2, No. 7.
Welch, William R. et al., "Nonelastomeric Sliding Sleeve Maintains Long Term Integrity in HP/HT Application: Case Histories" [Abstract Only], SPE Eastern Regional Meeting, Oct. 23-25, 1996, Columbus. Ohio.
Xiaotong Wang et al., "Contact-Damage-Resistant Ceramic/Single-Wall Carbon Nanotubes and Ceramic/Graphite Composites" Nature Materials, vol. 3, Aug. 2004, pp. 539-544.
Y. Zhang and Hongjie Dai, "Formation of metal nanowires on suspended single-walled carbon nanotubes" Applied Physics Letter, vol. 77, No. 19 (2000), pp. 3015-3017.
Y. Zhang, Nathan W. Franklin, Robert J. Chen, Hongjie Dai, "Metal Coating on Suspended Carbon Nanotubes and its Implication to Metal—Tube Interaction", Chemical Physics Letters 331 (2000) 35-41.
Yihua Zhu, Chunzhong Li, Qiufang Wu, "The process of coating on ultrafine particles by surface hydrolysis reaction in a fluidized bed reactor", Surface and Coatings Technology 135 (2000) 14-17.
Zeng et al. "Progress and Challenge for Magnesium Alloys as Biomaterials," Advanced Engineering Materials, vol. 10, Issue 8, Aug. 2008, pp. B3-B14.
International Search Report and Written Opinion of the International Searchign Authority mailed on Feb. 25, 2013 for International application No. PCT/US2012/053350 filed on Aug. 31, 2012.
International Search Report and Written Opinion of the International Searching Authority mailed on Feb. 15, 2013 for International App. No. PCT/US2012/053339 filed on Aug. 31, 2012.
Notification of Transmittal of the International Search Report and the Written Opinion of the International Searching Authority, or the Declaration; PCT/US2014/049347; Mailed Nov. 24, 2014; 11 Pages.
Xu, et al., "Nanostructured Material-Based Completion Tools Enhance Well Productivity"; International Petroleum Technology Conference; Conference Paper IPTC 16538; International Petroleum Technology Conference 2013; 4 pages.
Zhang, et al, "High Strength Nanostructured Materials and Their Oil Field Applications"; Society of Petroleum Engineers; Conference Paper SPE 157092; SPE International Oilfield Nanotechnology Conference, 2012; 6 pages.

* cited by examiner

DISSOLVABLE TOOL

CROSS REFERENCE TO RELATED APPLICATIONS

This application contains subject matter related to the subject matter of co-pending applications, which are assigned to the same assignee as this application, Baker Hughes Incorporated of Houston, Texas and are all being filed on Dec. 8, 2009. The below listed applications are hereby incorporated by reference in their entirety:

U.S. patent application Ser. No. 12/633,682, entitled NANOMATRIX POWDER METAL COMPACT;

U.S. patent application Ser. No. 12/633,686, entitled COATED METALLIC POWDER AND METHOD OF MAKING THE SAME;

U.S. patent application Ser. No. 12/633,688, entitled METHOD OF MAKING A NANOMATRIX POWDER METAL COMPACT;

U.S. patent application Ser. No. 12/633,678 entitled ENGINEERED POWDER COMPACT COMPOSITE MATERIAL;

U.S. Pat. No. 8,297,364 entitled TELESCOPIC UNIT WITH DISSOLVABLE BARRIER;

U.S. Pat. No. 8,327,931 entitled MULTI-COMPONENT DISAPPEARING TRIPPING BALL AND METHOD FOR MAKING THE SAME; and U.S. Pat. No. 8,403,037 entitled DISSOLVABLE TOOL AND METHOD.

BACKGROUND

In the subterranean drilling and completion industry there are times when a downhole tool located within a wellbore becomes an unwanted obstruction. Accordingly, downhole tools have been developed that can be deformed, by operator action, for example, such that the tool's presence becomes less burdensome. Although such tools work as intended, their presence, even in a deformed state can still be undesirable. Devices and methods to further remove the burden created by the presence of unnecessary downhole tools are therefore desirable in the art.

BRIEF DESCRIPTION

Disclosed herein is a method of dissolving a tool. The method includes, positioning the tool within an environment reactive with at least a portion of the tool, introducing the environment below a surface of the tool through at least one perforation formed therein, reacting at least a portion of the tool exposed to the environment through the at least one perforation, weakening the tool to mechanical stress, and fracturing the tool.

Further disclosed herein is a dissolvable tool. The tool includes, a body with a surface having at least one perforation therethrough, the at least one perforation being dimensioned to control a rate of intrusion of an environment reactive with at least a portion of the dissolvable tool located below the surface.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
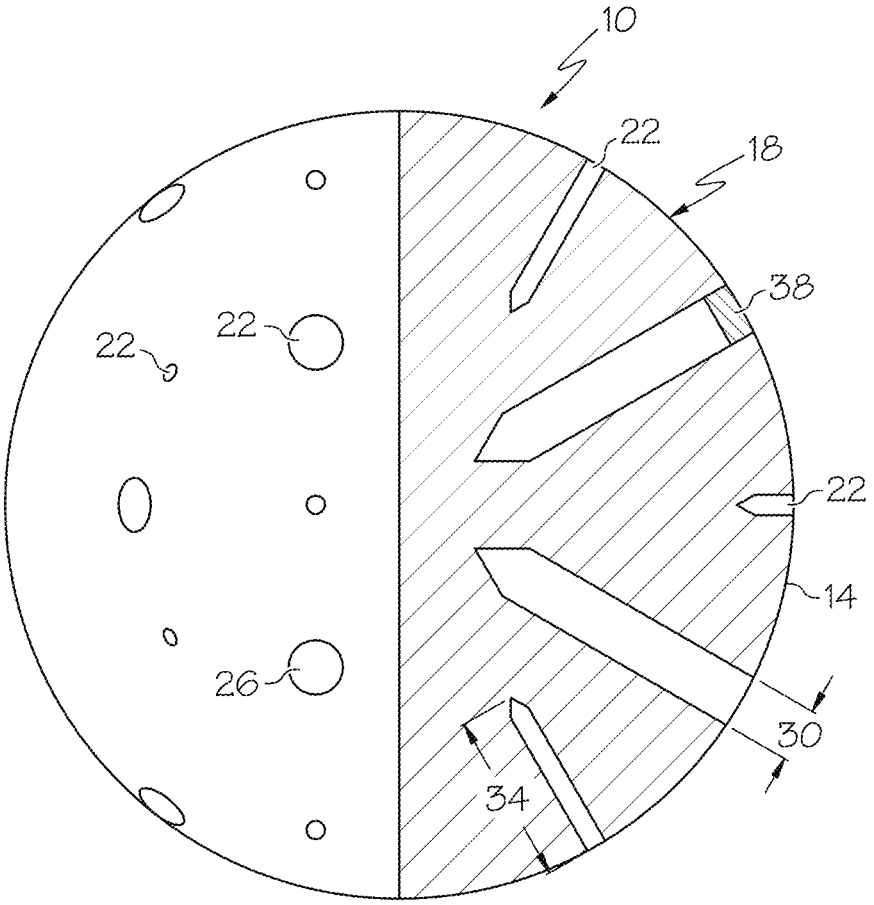
FIG. 1 depicts a quarter cross sectional view of a dissolvable tool disclosed herein.

Referring to FIG. 1, an embodiment of a dissolvable tool disclosed herein is illustrated generally at 10. The tool 10 includes a body 14, illustrated in this embodiment as a ball, however, alternate embodiments with alternate shapes, such as, a cylinder, an ellipsoid and a polyhedron, for example, are contemplated. The body 14 has a surface 18 that has a plurality of perforations 22 formed therein, although alternate embodiments may have differing numbers of the perforations 22 including embodiments having just a single perforation 22. Dimensions of the perforations 22, such as cross sectional area 26, diameter 30 (for perforations that have a circular cross section), and depth 34, for example, are selected to control a rate of intrusion of an environment into the tool 10 and below the surface 18. By controlling the rate of intrusion of the environment into the body 14 a rate of reaction of the material of the body 14 with the environment can also be controlled, as can be the rate at which the body 14 is weakened to a point wherein it can fail due to stress applied thereto.

In an application, such as the downhole hydrocarbon recovery industry, for example, the tool 10 can be a tripping ball. The ball 10 can be dropped or pumped within a wellbore (not shown), where it seals with a seat allowing pressure to be applied thereagainst to actuate a mechanism, such as a fracturing valve, for example, to open ports in the wellbore to facilitate treatments, like fracturing or acid treating, of a formation. In this application the downhole environment may include high temperatures, high pressures, and caustic chemicals such as acids, bases and brine solutions, for example. By making the body 14 of a material, such as, a lightweight, high-strength metallic material usable in both durable and disposable or degradable articles as disclosed in greater detail starting in paragraph [0028] below, the body 14 can be made to decrease in strength from exposure to the downhole environment. The initiation of dissolution or disintegration of the body 14 in the environment will decrease the strength of the body 14 and will allow the body 14 to fracture under stress, such as mechanical stress, for example. Examples of mechanical stress include stress from hydrostatic pressure and from a pressure differential applied across the body 14 as it is seated against a seat. The fracturing can break the body 14 into many small pieces that are not detrimental to further operation of the well, thereby negating the need to either pump the body 14 out of the wellbore or run a tool within the wellbore to drill or mill the body into pieces small enough to remove hindrance therefrom.

The dimensions 26, 30, 34 of the perforations 22 can be selected to expose selected values of surface area of the body 14 to the environment upon exposure, such as by submersion of the body 14, into the environment. By varying the depth 34 of the perforations 26, for example, an operator can assure that portions of the body 14 located deep within the body 14, such as near the center, will be exposed to the environment at nearly the same time that portions nearer to the surface 18 are exposed. In so doing, dissolution of the body 14 can be achieved more uniformly over the entire volume of the body 14 providing greater control over a rate of dissolution thereof.

Additionally, optional plugs 38 can be sealably engaged with the body 14 in at least one of the perforations 22. The plugs 38 can be configured through, porosity, material selection and adhesion to the body 14, for example, to provide additional control of a rate of exposure of the body 14, via the perforations 22, to the environment as well.

Figure 2:
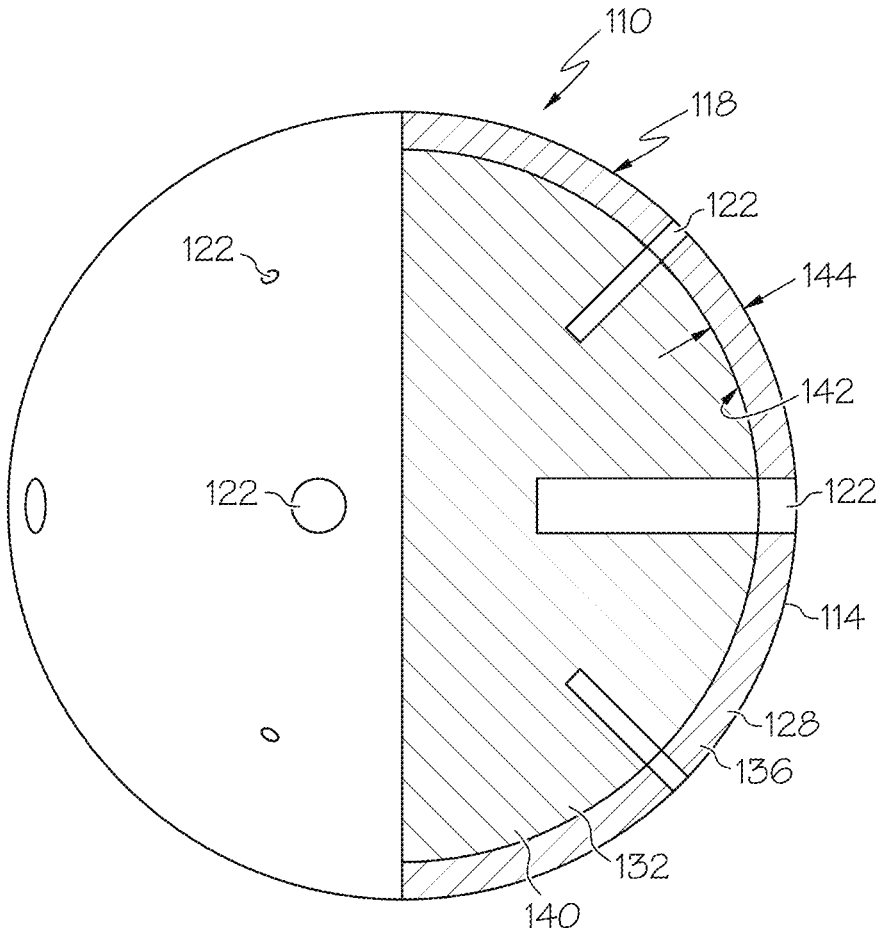
FIG. 2 depicts a quarter cross sectional view of an alternate embodiment of a dissolvable tool disclosed herein.
Figure 3:
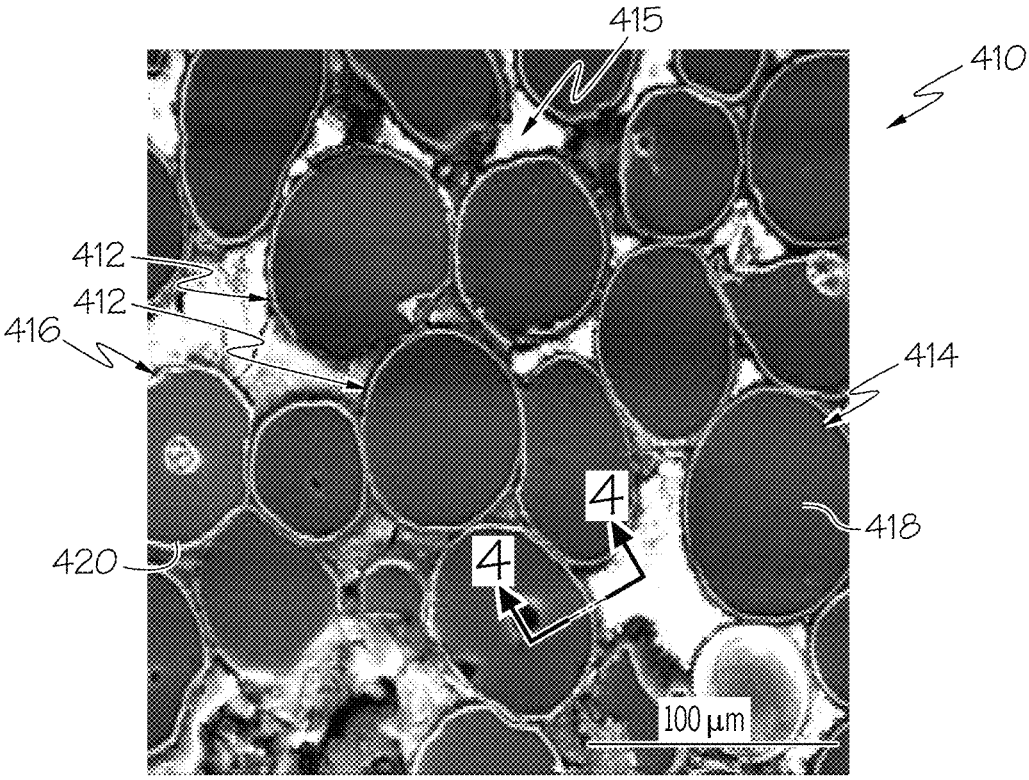
FIG. 3 is a photomicrograph of a powder as disclosed herein that has been embedded in a potting material and sectioned.
Figure 4:
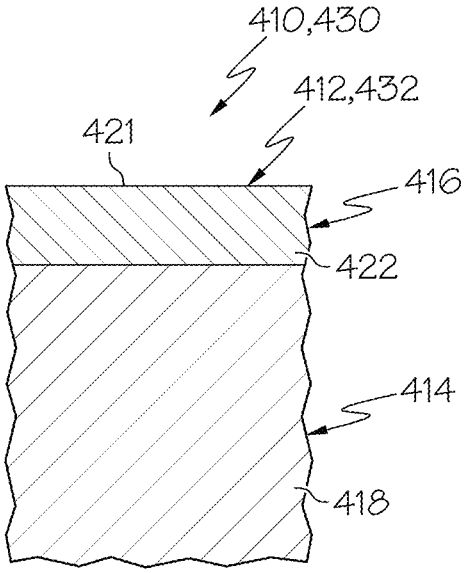
FIG. 4 is a schematic illustration of an exemplary embodiment of a powder particle as it would appear in an exemplary section view represented by section 4-4 of FIG. 3.

Referring to FIG. 2, an alternate embodiment of a dissolvable tool is illustrated generally at 110. The tool 110 is similar to the tool 10 and, therefore, only the differences between the two will be described here in detail. The tool 110 has a body 114, also illustrated as a ball, having a surface 118 with perforations 122 formed therethrough. The body 114 has a shell 128 that surrounds a core 132. In this embodiment the shell 128 is made of a first material 136 and the core 132 is made of a second material 140. The first material 136 is relatively inert to the environment and will resist dissolution when exposed to the environment, while the second material 140 is highly reactive in the environment thereby, as discussed in greater detail below, dissolving rather quickly when exposed to the environment. With such material selections, the first material 136 would remain substantially intact and unaffected by the elevated temperatures and brine found in the downhole environment of the downhole application discussed above. The second material 140, however, will dissolve relatively quickly once a significant portion of the second material 140 of the body 114 is exposed to brine after brine has penetrated below the shell 128 through the perforations 122 therein.

The shell 128 is intentionally configured to lack sufficient structural integrity to prevent fracture thereof under anticipated mechanical loads experienced during its intended use when not structurally supported by the core 132. Stated another way, the second material 140 of the core 132 prior to dissolution thereof supplies structural support to the shell 128. This structural support prevents fracture of the shell 128 during the intended use of the body 114. Consequently, the dissolution of the core 132, upon exposure of the core 132 to the environment, results in a removal of the structural support supplied by the core 132. Once this structural support is removed the shell 128 can fracture into a plurality of pieces of sufficiently small size that they are not detrimental to continued well operations. It should further be noted that the perforations 122 through the shell 128, in addition to allowing the environment to flow therethrough, also weaken the shell 128 by exposing additional surface area on an interior surface 142 of the shell 128 making it more vulnerable to fracture upon removal of the support of the core 132 once the core has dissolved. Parameters of the shell 128 that contribute to its insufficient strength include, material selection, material properties, and thickness 144.

Materials for the body 14, 114, 214, 314, may include, lightweight, high-strength metallic materials are disclosed that may be used in a wide variety of applications and application environments, including use in various wellbore environments to make various selectably and controllably disposable or degradable lightweight, high-strength downhole tools or other downhole components, as well as many other applications for use in both durable and disposable or degradable articles. These lightweight, high-strength and selectably and controllably degradable materials include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in wellbore applications. These powder compacts provide a unique and advantageous combination of mechanical strength properties, such as compression and shear strength, low density and selectable and controllable corrosion properties, particularly rapid and controlled dissolution in various wellbore fluids. For example, the particle core and coating layers of these powders may be selected to provide sintered powder compacts suitable for use as high strength engineered materials having a compressive strength and shear strength comparable to various other engineered materials, including carbon, stainless and alloy steels, but which also have a low density comparable to various polymers, elastomers, low-density porous ceramics and composite materials. As yet another example, these powders and powder compact materials may be configured to provide a selectable and controllable degradation or disposal in response to a change in an environmental condition, such as a transition from a very low dissolution rate to a very rapid dissolution rate in response to a change in a property or condition of a wellbore proximate an article formed from the compact, including a property change in a wellbore fluid that is in contact with the powder compact. The selectable and controllable degradation or disposal characteristics described also allow the dimensional stability and strength of articles, such as wellbore tools or other components, made from these materials to be maintained until they are no longer needed, at which time a predetermined environmental condition, such as a wellbore condition, including wellbore fluid temperature, pressure or pH value, may be changed to promote their removal by rapid dissolution. These coated powder materials and powder compacts and engineered materials formed from them, as well as methods of making them, are described further below.

Figure 5:
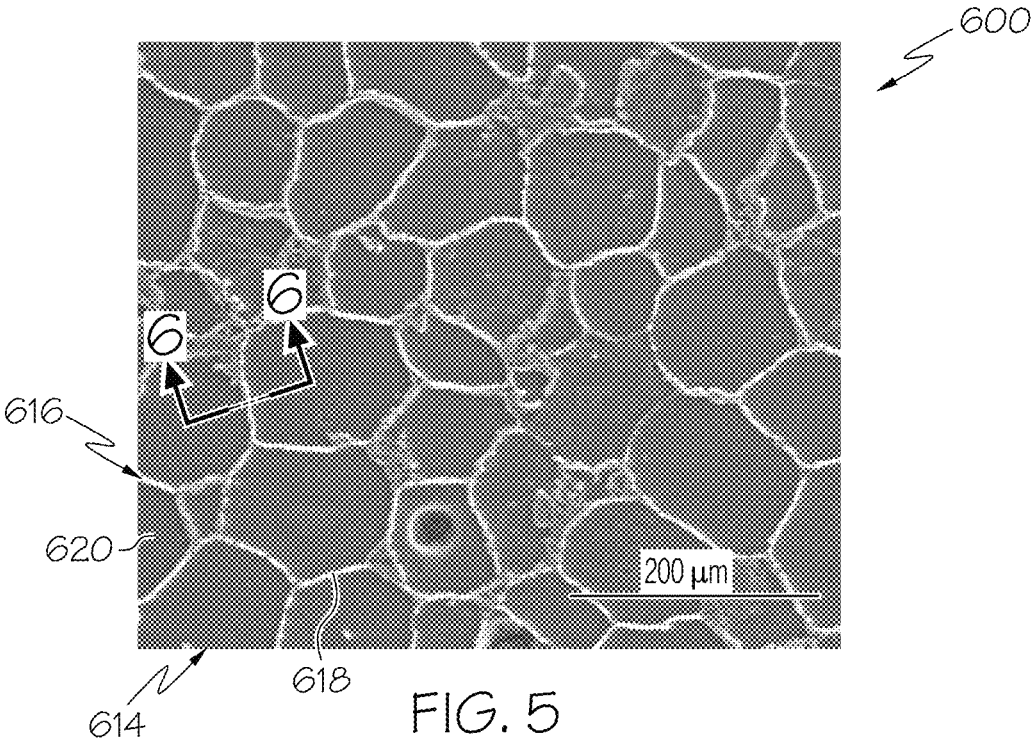
FIG. 5 is a photomicrograph of an exemplary embodiment of a powder compact as disclosed herein.

Referring to FIG. 5, a metallic powder 410 includes a plurality of metallic, coated powder particles 412. Powder particles 412 may be formed to provide a powder 410, including free-flowing powder, that may be poured or otherwise disposed in all manner of forms or molds (not shown) having all manner of shapes and sizes and that may be used to fashion powder compacts 600 (FIGS. 8 and 9), as described herein, that may be used as, or for use in manufacturing, various articles of manufacture, including various wellbore tools and components.

Each of the metallic, coated powder particles 412 of powder 410 includes a particle core 414 and a metallic coating layer 416 disposed on the particle core 414. The particle core 414 includes a core material 418. The core material 418 may include any suitable material for forming the particle core 414 that provides powder particle 412 that can be sintered to form a lightweight, high-strength powder compact 600 having selectable and controllable dissolution characteristics. Suitable core materials include electrochemically active metals having a standard oxidation potential greater than or equal to that of Zn, including as Mg, Al, Mn or Zn or a combination thereof. These electrochemically active metals are very reactive with a number of common wellbore fluids, including any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$). Core material 418 may also include other metals that are less electrochemically active than Zn or nonmetallic materials, or a combination thereof. Suitable nonmetallic materials include ceramics, composites, glasses or carbon, or a combination thereof Core material 418 may be selected to provide a high dissolution rate in a predetermined wellbore fluid, but may also be selected to provide a relatively low dissolution rate, including zero dissolution, where dissolution of the nanomatrix material causes the particle core 414 to be rapidly undermined and liberated from the particle compact at the interface with the wellbore fluid, such that the effective rate of dissolution of particle compacts made using particle cores 414 of these core materials 418 is high, even though core material 418 itself may have a low dissolution rate, including core materials 420 that may be substantially insoluble in the wellbore fluid.

With regard to the electrochemically active metals as core materials 418, including Mg, Al, Mn or Zn, these metals may be used as pure metals or in any combination with one another, including various alloy combinations of these materials, including binary, tertiary, or quaternary alloys of these materials. These combinations may also include composites of these materials. Further, in addition to combinations with one another, the Mg, Al, Mn or Zn core materials 418 may also include other constituents, including various alloying additions, to alter one or more properties of the particle cores 414, such as by improving the strength, lowering the density or altering the dissolution characteristics of the core material 418.

Among the electrochemically active metals, Mg, either as a pure metal or an alloy or a composite material, is particularly useful, because of its low density and ability to form high-strength alloys, as well as its high degree of electrochemical activity, since it has a standard oxidation potential higher than Al, Mn or Zn. Mg alloys include all alloys that have Mg as an alloy constituent. Mg alloys that combine other electrochemically active metals, as described herein, as alloy constituents are particularly useful, including binary Mg-Zn, Mg-Al and Mg-Mn alloys, as well as tertiary Mg-Zn-Y and Mg-Al-X alloys, where X includes Zn, Mn, Si, Ca or Y, or a combination thereof These Mg-Al-X alloys may include, by weight, up to about 85% Mg, up to about 15% Al and up to about 5% X. Particle core 414 and core material 418, and particularly electrochemically active metals including Mg, Al, Mn or Zn, or combinations thereof, may also include a rare earth element or combination of rare earth elements. As used herein, rare earth elements include Sc, Y, La, Ce, Pr, Nd or Er, or a combination of rare earth elements. Where present, a rare earth element or combinations of rare earth elements may be present, by weight, in an amount of about 5% or less.

Particle core 414 and core material 418 have a melting temperature ($T_P$). As used herein, $T_P$ includes the lowest temperature at which incipient melting or liquation or other forms of partial melting occur within core material 418, regardless of whether core material 418 comprises a pure metal, an alloy with multiple phases having different melting temperatures or a composite of materials having different melting temperatures.

Particle cores 414 may have any suitable particle size or range of particle sizes or distribution of particle sizes. For example, the particle cores 414 may be selected to provide an average particle size that is represented by a normal or Gaussian type unimodal distribution around an average or mean, as illustrated generally in FIG. 5. In another example, particle cores 414 may be selected or mixed to provide a multimodal distribution of particle sizes, including a plurality of average particle core sizes, such as, for example, a homogeneous bimodal distribution of average particle sizes. The selection of the distribution of particle core size may be used to determine, for example, the particle size and interparticle spacing 415 of the particles 412 of powder 410. In an exemplary embodiment, the particle cores 414 may have a unimodal distribution and an average particle diameter of about 5 μm to about 300 μm, more particularly about 80 μm to about 120 μm, and even more particularly about 100 μm.

Particle cores 414 may have any suitable particle shape, including any regular or irregular geometric shape, or combination thereof. In an exemplary embodiment, particle cores 414 are substantially spheroidal electrochemically active metal particles. In another exemplary embodiment, particle cores 414 are substantially irregularly shaped ceramic particles. In yet another exemplary embodiment, particle cores 414 are carbon or other nanotube structures or hollow glass microspheres.

Figure 6:
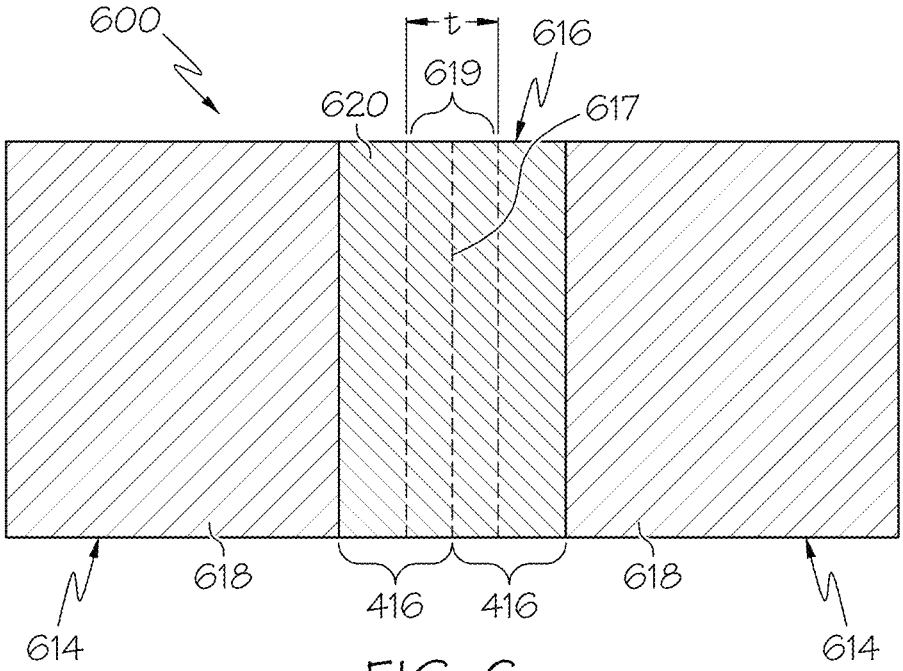
FIG. 6 is a schematic of illustration of an exemplary embodiment of the powder compact of FIG. 5 made using a powder having single-layer powder particles as it would appear taken along section 6-6.

Each of the metallic, coated powder particles 412 of powder 410 also includes a metallic coating layer 416 that is disposed on particle core 414. Metallic coating layer 416 includes a metallic coating material 420. Metallic coating material 420 gives the powder particles 412 and powder 410 its metallic nature. Metallic coating layer 16 is a nanoscale coating layer. In an exemplary embodiment, metallic coating layer 416 may have a thickness of about 25 nm to about 2500 nm. The thickness of metallic coating layer 416 may vary over the surface of particle core 414, but will preferably have a substantially uniform thickness over the surface of particle core 414. Metallic coating layer 416 may include a single layer, as illustrated in FIG. 6, or a plurality of layers as a multilayer coating structure. In a single layer coating, or in each of the layers of a multilayer coating, the metallic coating layer 416 may include a single constituent chemical element or compound, or may include a plurality of chemical elements or compounds. Where a layer includes a plurality of chemical constituents or compounds, they may have all manner of homogeneous or heterogeneous distributions, including a homogeneous or heterogeneous distribution of metallurgical phases. This may include a graded distribution where the relative amounts of the chemical constituents or compounds vary according to respective constituent profiles across the thickness of the layer. In both single layer and multilayer coatings 416, each of the respective layers, or combinations of them, may be used to provide a predetermined property to the powder particle 412 or a sintered powder compact formed therefrom. For example, the predetermined property may include the bond strength of the metallurgical bond between the particle core 414 and the coating material 420; the interdiffusion characteristics between the particle core 414 and metallic coating layer 416, including any interdiffusion between the layers of a multilayer coating layer 416; the interdiffusion characteristics between the various layers of a multilayer coating layer 416; the interdiffusion characteristics between the metallic coating layer 416 of one powder particle and that of an adjacent powder particle 412; the bond strength of the metallurgical bond between the metallic coating layers of adjacent sintered powder particles 412, including the outermost layers of multilayer coating layers; and the electrochemical activity of the coating layer 416.

Metallic coating layer 416 and coating material 420 have a melting temperature ($T_C$). As used herein, $T_C$ includes the lowest temperature at which incipient melting or liquation or other forms of partial melting occur within coating material 420, regardless of whether coating material 420 comprises a pure metal, an alloy with multiple phases each having different melting temperatures or a composite, including a composite comprising a plurality of coating material layers having different melting temperatures.

Metallic coating material 420 may include any suitable metallic coating material 20 that provides a sinterable outer surface 421 that is configured to be sintered to an adjacent powder particle 412 that also has a metallic coating layer 416 and sinterable outer surface 421. In powders 410 that also include second or additional (coated or uncoated) particles 432, as described herein, the sinterable outer surface 421 of metallic coating layer 416 is also configured to be sintered to a sinterable outer surface 421 of second particles 432. In an exemplary embodiment, the powder particles 412 are sinterable at a predetermined sintering temperature ($T_S$) that is a function of the core material 418 and coating material 420, such that sintering of powder compact 600 is accomplished entirely in the solid state and where $T_S$ is less than $T_P$ and $T_C$. Sintering in the solid state limits particle core 414/metallic coating layer 416 interactions to solid state diffusion processes and metallurgical transport phenomena and limits growth of and provides control over the resultant interface between them. In contrast, for example, the introduction of liquid phase sintering would provide for rapid interdiffusion of the particle core 414/metallic coating layer 416 materials and make it difficult to limit the growth of and provide control over the resultant interface between them, and thus interfere with the formation of the desirable microstructure of particle compact 600 as described herein.

In an exemplary embodiment, core material 418 will be selected to provide a core chemical composition and the coating material 420 will be selected to provide a coating chemical composition and these chemical compositions will also be selected to differ from one another. In another exemplary embodiment, the core material 418 will be selected to provide a core chemical composition and the coating material 420 will be selected to provide a coating chemical composition and these chemical compositions will also be selected to differ from one another at their interface. Differences in the chemical compositions of coating material 420 and core material 418 may be selected to provide different dissolution rates and selectable and controllable dissolution of powder compacts 600 that incorporate them making them selectably and controllably dissolvable. This includes dissolution rates that differ in response to a changed condition in the wellbore, including an indirect or direct change in a wellbore fluid. In an exemplary embodiment, a powder compact 600 formed from powder 410 having chemical compositions of core material 418 and coating material 420 that make compact 600 is selectably dissolvable in a wellbore fluid in response to a changed wellbore condition that includes a change in temperature, change in pressure, change in flow rate, change in pH or change in chemical composition of the wellbore fluid, or a combination thereof. The selectable dissolution response to the changed condition may result from actual chemical reactions or processes that promote different rates of dissolution, but also encompass changes in the dissolution response that are associated with physical reactions or processes, such as changes in wellbore fluid pressure or flow rate.

Figure 7:
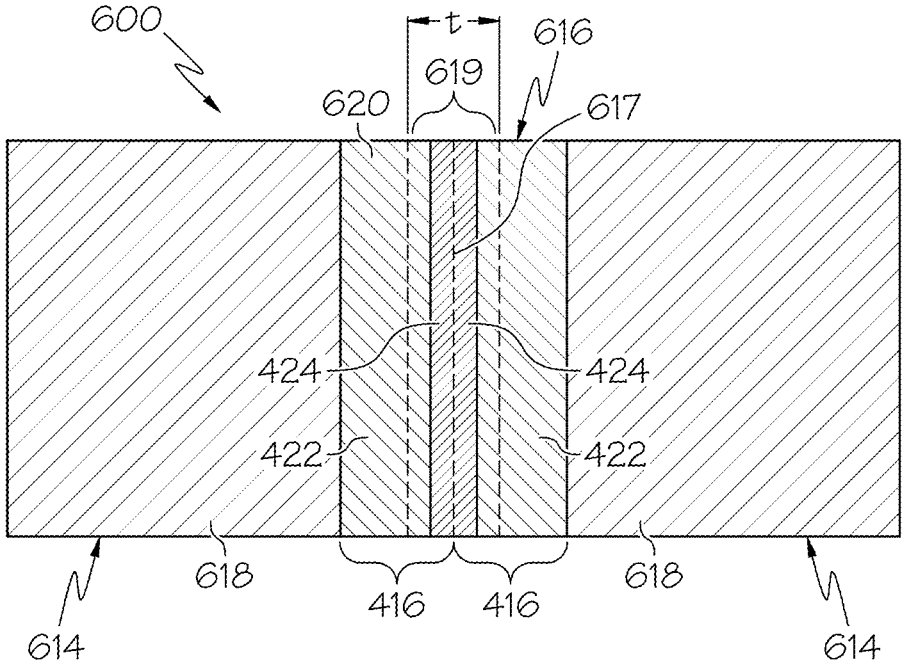
FIG. 7 is a schematic of illustration of another exemplary embodiment of the powder compact of FIG. 5 made using a powder having multilayer powder particles as it would appear taken along section 6-6.

As illustrated in FIGS. 5 and 7, particle core 414 and core material 418 and metallic coating layer 416 and coating material 420 may be selected to provide powder particles 412 and a powder 410 that is configured for compaction and sintering to provide a powder compact 600 that is lightweight (i.e., having a relatively low density), high-strength and is selectably and controllably removable from a wellbore in response to a change in a wellbore property, including being selectably and controllably dissolvable in an appropriate wellbore fluid, including various wellbore fluids as disclosed herein. Powder compact 600 includes a substantially-continuous, cellular nanomatrix 616 of a nanomatrix material 620 having a plurality of dispersed particles 614 dispersed throughout the cellular nanomatrix 616. The substantially-continuous cellular nanomatrix 616 and nanomatrix material 620 formed of sintered metallic coating layers 416 is formed by the compaction and sintering of the plurality of metallic coating layers 416 of the plurality of powder particles 412. The chemical composition of nanomatrix material 620 may be different than that of coating material 420 due to diffusion effects associated with the sintering as described herein. Powder metal compact 600 also includes a plurality of dispersed particles 614 that comprise particle core material 618. Dispersed particle cores 614 and core material 618 correspond to and are formed from the plurality of particle cores 414 and core material 418 of the plurality of powder particles 412 as the metallic coating layers 416 are sintered together to form nanomatrix 616. The chemical composition of core material 618 may be different than that of core material 418 due to diffusion effects associated with sintering as described herein.

As used herein, the use of the term substantially-continuous cellular nanomatrix 616 does not connote the major constituent of the powder compact, but rather refers to the minority constituent or constituents, whether by weight or by volume. This is distinguished from most matrix composite materials where the matrix comprises the majority constituent by weight or volume. The use of the term substantially-continuous, cellular nanomatrix is intended to describe the extensive, regular, continuous and interconnected nature of the distribution of nanomatrix material 620 within powder compact 600. As used herein, "substantially-continuous" describes the extension of the nanomatrix material throughout powder compact 600 such that it extends between and envelopes substantially all of the dispersed particles 614. Substantially-continuous is used to indicate that complete continuity and regular order of the nanomatrix around each dispersed particle 614 is not required. For example, defects in the coating layer 416 over particle core 414 on some powder particles 412 may cause bridging of the particle cores 414 during sintering of the powder compact 600, thereby causing localized discontinuities to result within the cellular nanomatrix 616, even though in the other portions of the powder compact the nanomatrix is substantially continuous and exhibits the structure described herein. As used herein, "cellular" is used to indicate that the nanomatrix defines a network of generally repeating, interconnected, compartments or cells of nanomatrix material 620 that encompass and also interconnect the dispersed particles 614. As used herein, "nanomatrix" is used to describe the size or scale of the matrix, particularly the thickness of the matrix between adjacent dispersed particles 614. The metallic coating layers that are sintered together to form the nanomatrix are themselves nanoscale thickness coating layers. Since the nanomatrix at most locations, other than the intersection of more than two dispersed particles 614, generally comprises the interdiffusion and bonding of two coating layers 416 from adjacent powder particles 412 having nanoscale thicknesses, the matrix formed also has a nanoscale thickness (e.g., approximately two times the coating layer thickness as described herein) and is thus described as a nanomatrix. Further, the use of the term dispersed particles 614 does not connote the minor constituent of powder compact 600, but rather refers to the majority constituent or constituents, whether by weight or by volume. The use of the term dispersed particle is intended to convey the discontinuous and discrete distribution of particle core material 618 within powder compact 600.

Powder compact 600 may have any desired shape or size, including that of a cylindrical billet or bar that may be machined or otherwise used to form useful articles of manufacture, including various wellbore tools and components. The sintering and pressing processes used to form powder compact 600 and deform the powder particles 412, including particle cores 414 and coating layers 416, to provide the full density and desired macroscopic shape and size of powder compact 600 as well as its microstructure. The microstructure of powder compact 600 includes an equiaxed configuration of dispersed particles 614 that are dispersed throughout and embedded within the substantially-continuous, cellular nanomatrix 616 of sintered coating layers. This microstructure is somewhat analogous to an equiaxed grain microstructure with a continuous grain boundary phase, except that it does not require the use of alloy constituents having thermodynamic phase equilibria properties that are capable of producing such a structure. Rather, this equiaxed dispersed particle structure and cellular nanomatrix 616 of sintered metallic coating layers 416 may be produced using constituents where thermodynamic phase equilibrium conditions would not produce an equiaxed structure. The equiaxed morphology of the dispersed particles 614 and cellular network 616 of particle layers results from sintering and deformation of the powder particles 412 as they are compacted and interdiffuse and deform to fill the interparticle spaces 415 (FIG. 5). The sintering temperatures and pressures may be selected to ensure that the density of powder compact 600 achieves substantially full theoretical density.

Figure 8:
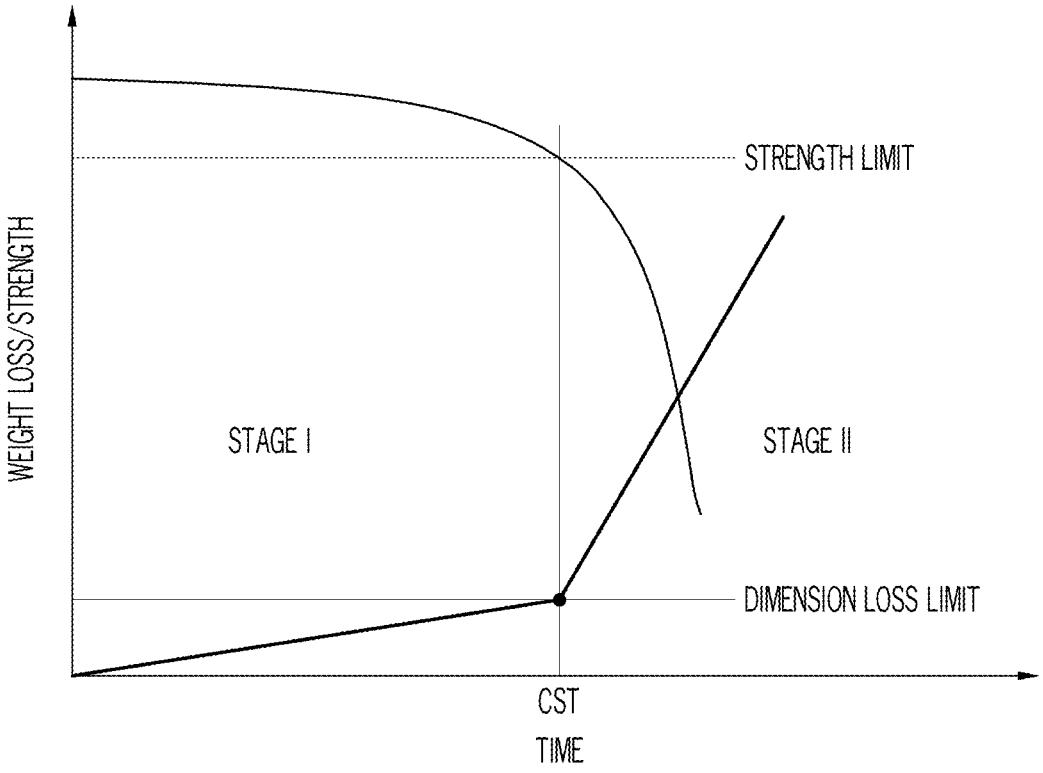
FIG. 8 is a schematic illustration of a change in a property of a powder compact as disclosed herein as a function of time and a change in condition of the powder compact environment.

In an exemplary embodiment as illustrated in FIGS. 5 and 7, dispersed particles 614 are formed from particle cores 414 dispersed in the cellular nanomatrix 616 of sintered metallic coating layers 416, and the nanomatrix 616 includes a solid-state metallurgical bond 617 or bond layer 619, as illustrated schematically in FIG. 8, extending between the dispersed particles 614 throughout the cellular nanomatrix 616 that is formed at a sintering temperature ($T_S$), where $T_S$ is less than $T_C$ and $T_P$. As indicated, solid-state metallurgical bond 617 is formed in the solid state by solid-state interdiffusion between the coating layers 416 of adjacent powder particles 412 that are compressed into touching contact during the compaction and sintering processes used to form powder compact 600, as described herein. As such, sintered coating layers 416 of cellular nanomatrix 616 include a solid-state bond layer 619 that has a thickness (t) defined by the extent of the interdiffusion of the coating materials 420 of the coating layers 416, which will in turn be defined by the nature of the coating layers 416, including whether they are single or multilayer coating layers, whether they have been selected to promote or limit such interdiffusion, and other factors, as described herein, as well as the sintering and compaction conditions, including the sintering time, temperature and pressure used to form powder compact 600.

As nanomatrix 616 is formed, including bond 617 and bond layer 619, the chemical composition or phase distribution, or both, of metallic coating layers 416 may change. Nanomatrix 616 also has a melting temperature ($T_M$). As used herein, $T_M$ includes the lowest temperature at which incipient melting or liquation or other forms of partial melting will occur within nanomatrix 616, regardless of whether nanomatrix material 620 comprises a pure metal, an alloy with multiple phases each having different melting temperatures or a composite, including a composite comprising a plurality of layers of various coating materials having different melting temperatures, or a combination thereof, or otherwise. As dispersed particles 614 and particle core materials 618 are formed in conjunction with nanomatrix 616, diffusion of constituents of metallic coating layers 416 into the particle cores 414 is also possible, which may result in changes in the chemical composition or phase distribution, or both, of particle cores 414. As a result, dispersed particles 614 and particle core materials 618 may have a melting temperature ($T_{DP}$) that is different than $T_P$. As used herein, $T_{DP}$ includes the lowest temperature at which incipient melting or liquation or other forms of partial melting will occur within dispersed particles 614, regardless of whether particle core material 618 comprise a pure metal, an alloy with multiple phases each having different melting temperatures or a composite, or otherwise. Powder compact 600 is formed at a sintering temperature ($T_S$), where $T_S$ is less than $T_C$,$T_P$, $T_M$ and $T_{DP}$.

Dispersed particles 614 may comprise any of the materials described herein for particle cores 414, even though the chemical composition of dispersed particles 614 may be different due to diffusion effects as described herein. In an exemplary embodiment, dispersed particles 614 are formed from particle cores 414 comprising materials having a standard oxidation potential greater than or equal to Zn, including Mg, Al, Zn or Mn, or a combination thereof, may include various binary, tertiary and quaternary alloys or other combinations of these constituents as disclosed herein in conjunction with particle cores 414. Of these materials, those having dispersed particles 614 comprising Mg and the nanomatrix 616 formed from the metallic coating materials 416 described herein are particularly useful. Dispersed particles 614 and particle core material 618 of Mg, Al, Zn or Mn, or a combination thereof, may also include a rare earth element, or a combination of rare earth elements as disclosed herein in conjunction with particle cores 414.

In another exemplary embodiment, dispersed particles 614 are formed from particle cores 414 comprising metals that are less electrochemically active than Zn or non-metallic materials. Suitable non-metallic materials include ceramics, glasses (e.g., hollow glass microspheres) or carbon, or a combination thereof, as described herein.

Dispersed particles 614 of powder compact 600 may have any suitable particle size, including the average particle sizes described herein for particle cores 414.

Dispersed particles 614 may have any suitable shape depending on the shape selected for particle cores 414 and powder particles 412, as well as the method used to sinter and compact powder 410. In an exemplary embodiment, powder particles 412 may be spheroidal or substantially spheroidal and dispersed particles 614 may include an equiaxed particle configuration as described herein.

The nature of the dispersion of dispersed particles 614 may be affected by the selection of the powder 410 or powders 410 used to make particle compact 600. In one exemplary embodiment, a powder 410 having a unimodal distribution of powder particle 412 sizes may be selected to form powder compact 600 and will produce a substantially homogeneous unimodal dispersion of particle sizes of dispersed particles 614 within cellular nanomatrix 616, as illustrated generally in FIG. 7. In another exemplary embodiment, a plurality of powders 410 having a plurality of powder particles with particle cores 414 that have the same core materials 418 and different core sizes and the same coating material 420 may be selected and uniformly mixed as described herein to provide a powder 410 having a homogenous, multimodal distribution of powder particle 412 sizes, and may be used to form powder compact 600 having a homogeneous, multimodal dispersion of particle sizes of dispersed particles 614 within cellular nanomatrix 616. Similarly, in yet another exemplary embodiment, a plurality of powders 410 having a plurality of particle cores 414 that may have the same core materials 418 and different core sizes and the same coating material 420 may be selected and distributed in a non-uniform manner to provide a non-homogenous, multimodal distribution of powder particle sizes, and may be used to form powder compact 600 having a non-homogeneous, multimodal dispersion of particle sizes of dispersed particles 614 within cellular nanomatrix 616. The selection of the distribution of particle core size may be used to determine, for example, the particle size and interparticle spacing of the dispersed particles 614 within the cellular nanomatrix 616 of powder compacts 600 made from powder 410.

Nanomatrix 616 is a substantially-continuous, cellular network of metallic coating layers 416 that are sintered to one another. The thickness of nanomatrix 616 will depend on the nature of the powder 410 or powders 410 used to form powder compact 600, as well as the incorporation of any second powder 430, particularly the thicknesses of the coating layers associated with these particles. In an exemplary embodiment, the thickness of nanomatrix 616 is substantially uniform throughout the microstructure of powder compact 600 and comprises about two times the thickness of the coating layers 416 of powder particles 412. In another exemplary embodiment, the cellular network 616 has a substantially uniform average thickness between dispersed particles 614 of about 50 nm to about 5000 nm.

Nanomatrix 616 is formed by sintering metallic coating layers 416 of adjacent particles to one another by interdiffusion and creation of bond layer 619 as described herein. Metallic coating layers 416 may be single layer or multilayer structures, and they may be selected to promote or inhibit diffusion, or both, within the layer or between the layers of metallic coating layer 416, or between the metallic coating layer 416 and particle core 414, or between the metallic coating layer 416 and the metallic coating layer 416 of an adjacent powder particle, the extent of interdiffusion of metallic coating layers 416 during sintering may be limited or extensive depending on the coating thicknesses, coating material or materials selected, the sintering conditions and other factors. Given the potential complexity of the interdiffusion and interaction of the constituents, description of the resulting chemical composition of nanomatrix 616 and nanomatrix material 620 may be simply understood to be a combination of the constituents of coating layers 416 that may also include one or more constituents of dispersed particles 614, depending on the extent of interdiffusion, if any, that occurs between the dispersed particles 614 and the nanomatrix 616. Similarly, the chemical composition of dispersed particles 614 and particle core material 618 may be simply understood to be a combination of the constituents of particle core 414 that may also include one or more constituents of nanomatrix 616 and nanomatrix material 620, depending on the extent of interdiffusion, if any, that occurs between the dispersed particles 614 and the nanomatrix 616.

In an exemplary embodiment, the nanomatrix material 620 has a chemical composition and the particle core material 618 has a chemical composition that is different from that of nanomatrix material 620, and the differences in the chemical compositions may be configured to provide a selectable and controllable dissolution rate, including a selectable transition from a very low dissolution rate to a very rapid dissolution rate, in response to a controlled change in a property or condition of the wellbore proximate the compact 600, including a property change in a wellbore fluid that is in contact with the powder compact 600, as described herein. Nanomatrix 616 may be formed from powder particles 412 having single layer and multilayer coating layers 416. This design flexibility provides a large number of material combinations, particularly in the case of multilayer coating layers 416, that can be utilized to tailor the cellular nanomatrix 616 and composition of nanomatrix material 620 by controlling the interaction of the coating layer constituents, both within a given layer, as well as between a coating layer 416 and the particle core 414 with which it is associated or a coating layer 416 of an adjacent powder particle 412. Several exemplary embodiments that demonstrate this flexibility are provided below.

As illustrated in FIG. 8, in an exemplary embodiment, powder compact 600 is formed from powder particles 412 where the coating layer 416 comprises a single layer, and the resulting nanomatrix 616 between adjacent ones of the plurality of dispersed particles 614 comprises the single metallic coating layer 416 of one powder particle 412, a bond layer 619 and the single coating layer 416 of another one of the adjacent powder particles 412. The thickness (t) of bond layer 619 is determined by the extent of the interdiffusion between the single metallic coating layers 416, and may encompass the entire thickness of nanomatrix 616 or only a portion thereof. In one exemplary embodiment of powder compact 600 formed using a single layer powder 410, powder compact 600 may include dispersed particles 614 comprising Mg, Al, Zn or Mn, or a combination thereof, as described herein, and nanomatrix 616 may include Al, Zn, Mn, Mg, Mo, W, Cu, Fe, Si, Ca, Co, Ta, Re or Ni, or an oxide, carbide or nitride thereof, or a combination of any of the aforementioned materials, including combinations where the nanomatrix material 620 of cellular nanomatrix 616, including bond layer 619, has a chemical composition and the core material 618 of dispersed particles 614 has a chemical composition that is different than the chemical composition of nanomatrix material 616. The difference in the chemical composition of the nanomatrix material 620 and the core material 618 may be used to provide selectable and controllable dissolution in response to a change in a property of a wellbore, including a wellbore fluid, as described herein. In a further exemplary embodiment of a powder compact 600 formed from a powder 410 having a single coating layer configuration, dispersed particles 614 include Mg, Al, Zn or Mn, or a combination thereof, and the cellular nanomatrix 616 includes Al or Ni, or a combination thereof.

As illustrated in FIG. 9, in another exemplary embodiment, powder compact 600 is formed from powder particles 412 where the coating layer 416 comprises a multilayer coating layer 416 having a plurality of coating layers, and the resulting nanomatrix 616 between adjacent ones of the plurality of dispersed particles 614 comprises the plurality of layers (t) comprising the coating layer 416 of one particle 412, a bond layer 619, and the plurality of layers comprising the coating layer 416 of another one of powder particles 412. In FIG. 9, this is illustrated with a two-layer metallic coating layer 416, but it will be understood that the plurality of layers of multilayer metallic coating layer 416 may include any desired number of layers. The thickness (t) of the bond layer 619 is again determined by the extent of the interdiffusion between the plurality of layers of the respective coating layers 416, and may encompass the entire thickness of nanomatrix 616 or only a portion thereof. In this embodiment, the plurality of layers comprising each coating layer 416 may be used to control interdiffusion and formation of bond layer 619 and thickness (t).

Sintered and forged powder compacts 600 that include dispersed particles 614 comprising Mg and nanomatrix 616 comprising various nanomatrix materials as described herein have demonstrated an excellent combination of mechanical strength and low density that exemplify the lightweight, high-strength materials disclosed herein. Examples of powder compacts 600 that have pure Mg dispersed particles 614 and various nanomatrices 616 formed from powders 410 having pure Mg particle cores 414 and various single and multilayer metallic coating layers 416 that include Al, Ni, W or $Al_2O_3$, or a combination thereof. These powders compacts 600 have been subjected to various mechanical and other testing, including density testing, and their dissolution and mechanical property degradation behavior has also been characterized as disclosed herein. The results indicate that these materials may be configured to provide a wide range of selectable and controllable corrosion or dissolution behavior from very low corrosion rates to extremely high corrosion rates, particularly corrosion rates that are both lower and higher than those of powder compacts that do not incorporate the cellular nanomatrix, such as a compact formed from pure Mg powder through the same compaction and sintering processes in comparison to those that include pure Mg dispersed particles in the various cellular nanomatrices described herein. These powder compacts 600 may also be configured to provide substantially enhanced properties as compared to powder compacts formed from pure Mg particles that do not include the nanoscale coatings described herein. Powder compacts 600 that include dispersed particles 614 comprising Mg and nanomatrix 616 comprising various nanomatrix materials 620 described herein have demonstrated room temperature compressive strengths of at least about 37 ksi, and have further demonstrated room temperature compressive strengths in excess of about 50 ksi, both dry and immersed in a solution of 3% KCl at 200° F. In contrast, powder compacts formed from pure Mg powders have a compressive strength of about 20 ksi or less. Strength of the nanomatrix powder metal compact 600 can be further improved by optimizing powder 410, particularly the weight percentage of the nanoscale metallic coating layers 416 that are used to form cellular nanomatrix 616. Strength of the nanomatrix powder metal compact 600 can be further improved by optimizing powder 410, particularly the weight percentage of the nanoscale metallic coating layers 416 that are used to form cellular nanomatrix 616. For example, varying the weight percentage (wt. %), i.e., thickness, of an alumina coating within a cellular nanomatrix 616 formed from coated powder particles 412 that include a multilayer ($Al/Al_2O_3/Al$) metallic coating layer 416 on pure Mg particle cores 414 provides an increase of 21% as compared to that of 0 wt % alumina.

Powder compacts 600 comprising dispersed particles 614 that include Mg and nanomatrix 616 that includes various nanomatrix materials as described herein have also demonstrated a room temperature sheer strength of at least about 20 ksi. This is in contrast with powder compacts formed from pure Mg powders which have room temperature sheer strengths of about 8 ksi.

Powder compacts 600 of the types disclosed herein are able to achieve an actual density that is substantially equal to the predetermined theoretical density of a compact material based on the composition of powder 410, including relative amounts of constituents of particle cores 414 and metallic coating layer 416, and are also described herein as being fully-dense powder compacts. Powder compacts 600 comprising dispersed particles that include Mg and nanomatrix 616 that includes various nanomatrix materials as described herein have demonstrated actual densities of about 1.738 $g/cm^3$ to about 2.50 $g/cm^3$, which are substantially equal to the predetermined theoretical densities, differing by at most 4% from the predetermined theoretical densities.

Powder compacts 600 as disclosed herein may be configured to be selectively and controllably dissolvable in a wellbore fluid in response to a changed condition in a wellbore. Examples of the changed condition that may be exploited to provide selectable and controllable dissolvability include a change in temperature, change in pressure, change in flow rate, change in pH or change in chemical composition of the wellbore fluid, or a combination thereof. An example of a changed condition comprising a change in temperature includes a change in well bore fluid temperature. For example, powder compacts 600 comprising dispersed particles 614 that include Mg and cellular nanomatrix 616 that includes various nanomatrix materials as described herein have relatively low rates of corrosion in a 3% KCl solution at room temperature that range from about 0 to about 11 $mg/cm^2/hr$ as compared to relatively high rates of corrosion at 200° F. that range from about 1 to about 246 $mg/cm^2/hr$ depending on different nanoscale coating layers 416. An example of a changed condition comprising a change in chemical composition includes a change in a chloride ion concentration or pH value, or both, of the wellbore fluid. For example, powder compacts 600 comprising dispersed particles 614 that include Mg and nanomatrix 616 that includes various nanoscale coatings described herein demonstrate corrosion rates in 15% HCl that range from about 4750 $mg/cm^2/hr$ to about 7432 $mg/cm^2/hr$. Thus, selectable and controllable dissolvability in response to a changed condition in the wellbore, namely the change in the wellbore fluid chemical composition from KCl to HCl, may be used to achieve a characteristic response as illustrated graphically in FIG. 10, which illustrates that at a selected predetermined critical service time (CST) a changed condition may be imposed upon powder compact 600 as it is applied in a given application, such as a wellbore environment, that causes a controllable change in a property of powder compact 600 in response to a changed condition in the environment in which it is applied. For example, at a predetermined CST changing a wellbore fluid that is in contact with powder contact 600 from a first fluid (e.g. KCl) that provides a first corrosion rate and an associated weight loss or strength as a function of time to a second wellbore fluid (e.g., HCl) that provides a second corrosion rate and associated weight loss and strength as a function of time, wherein the corrosion rate associated with the first fluid is much less than the corrosion rate associated with the second fluid. This characteristic response to a change in wellbore fluid conditions may be used, for example, to associate the critical service time with a dimension loss limit or a minimum strength needed for a particular application, such that when a wellbore tool or component formed from powder compact 600 as disclosed herein is no longer needed in service in the wellbore (e.g., the CST) the condition in the wellbore (e.g., the chloride ion concentration of the wellbore fluid) may be changed to cause the rapid dissolution of powder compact 600 and its removal from the wellbore. In the example described above, powder compact 600 is selectably dissolvable at a rate that ranges from about 0 to about 7000 mg/cm$^2$/hr. This range of response provides, for example the ability to remove a 3 inch diameter ball formed from this material from a wellbore by altering the wellbore fluid in less than one hour. The selectable and controllable dissolvability behavior described above, coupled with the excellent strength and low density properties described herein, define a new engineered dispersed particle-nanomatrix material that is configured for contact with a fluid and configured to provide a selectable and controllable transition from one of a first strength condition to a second strength condition that is lower than a functional strength threshold, or a first weight loss amount to a second weight loss amount that is greater than a weight loss limit, as a function of time in contact with the fluid. The dispersed particle-nanomatrix composite is characteristic of the powder compacts 600 described herein and includes a cellular nanomatrix 616 of nanomatrix material 620, a plurality of dispersed particles 614 including particle core material 618 that is dispersed within the matrix. Nanomatrix 616 is characterized by a solid-state bond layer 619 which extends throughout the nanomatrix. The time in contact with the fluid described above may include the CST as described above. The CST may include a predetermined time that is desired or required to dissolve a predetermined portion of the powder compact 600 that is in contact with the fluid. The CST may also include a time corresponding to a change in the property of the engineered material or the fluid, or a combination thereof. In the case of a change of property of the engineered material, the change may include a change of a temperature of the engineered material. In the case where there is a change in the property of the fluid, the change may include the change in a fluid temperature, pressure, flow rate, chemical composition or pH or a combination thereof. Both the engineered material and the change in the property of the engineered material or the fluid, or a combination thereof, may be tailored to provide the desired CST response characteristic, including the rate of change of the particular property (e.g., weight loss, loss of strength) both prior to the CST (e.g., Stage 1) and after the CST (e.g., Stage 2), as illustrated in FIG. 10.

Without being limited by theory, powder compacts 600 are formed from coated powder particles 412 that include a particle core 414 and associated core material 418 as well as a metallic coating layer 416 and an associated metallic coating material 420 to form a substantially-continuous, three-dimensional, cellular nanomatrix 616 that includes a nanomatrix material 620 formed by sintering and the associated diffusion bonding of the respective coating layers 416 that includes a plurality of dispersed particles 614 of the particle core materials 618. This unique structure may include metastable combinations of materials that would be very difficult or impossible to form by solidification from a melt having the same relative amounts of the constituent materials. The coating layers and associated coating materials may be selected to provide selectable and controllable dissolution in a predetermined fluid environment, such as a wellbore environment, where the predetermined fluid may be a commonly used wellbore fluid that is either injected into the wellbore or extracted from the wellbore. As will be further understood from the description herein, controlled dissolution of the nanomatrix exposes the dispersed particles of the core materials. The particle core materials may also be selected to also provide selectable and controllable dissolution in the wellbore fluid. Alternately, they may also be selected to provide a particular mechanical property, such as compressive strength or sheer strength, to the powder compact 600, without necessarily providing selectable and controlled dissolution of the core materials themselves, since selectable and controlled dissolution of the nanomatrix material surrounding these particles will necessarily release them so that they are carried away by the wellbore fluid. The microstructural morphology of the substantially-continuous, cellular nanomatrix 616, which may be selected to provide a strengthening phase material, with dispersed particles 614, which may be selected to provide equiaxed dispersed particles 614, provides these powder compacts with enhanced mechanical properties, including compressive strength and sheer strength, since the resulting morphology of the nanomatrix/dispersed particles can be manipulated to provide strengthening through the processes that are akin to traditional strengthening mechanisms, such as grain size reduction, solution hardening through the use of impurity atoms, precipitation or age hardening and strength/work hardening mechanisms. The nanomatrix/dispersed particle structure tends to limit dislocation movement by virtue of the numerous particle nanomatrix interfaces, as well as interfaces between discrete layers within the nanomatrix material as described herein. This is exemplified in the fracture behavior of these materials. A powder compact 600 made using uncoated pure Mg powder and subjected to a shear stress sufficient to induce failure demonstrated intergranular fracture. In contrast, a powder compact 600 made using powder particles 412 having pure Mg powder particle cores 414 to form dispersed particles 614 and metallic coating layers 416 that includes Al to form nanomatrix 616 and subjected to a shear stress sufficient to induce failure demonstrated transgranular fracture and a substantially higher fracture stress as described herein. Because these materials have high-strength characteristics, the core material and coating material may be selected to utilize low density materials or other low density materials, such as low-density metals, ceramics, glasses or carbon, that otherwise would not provide the necessary strength characteristics for use in the desired applications, including wellbore tools and components.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A dissolvable tool comprising a body with a surface having at least one perforation therethrough, the at least one perforation being dimensioned to control a rate of intrusion of an environment reactive with at least a portion of the dissolvable tool located below the surface the body being made of a powder metal compact, comprising:

a substantially-continuous, cellular nanomatrix comprising a nanomatrix material;

a plurality of dispersed particles comprising a particle core material that comprises Mg, Al, Zn or Mn, or a combination thereof, dispersed in the cellular nanomatrix; and a solid-state bond layer extending throughout the cellular nanomatrix between the dispersed particles.

2. The dissolvable tool of claim 1, wherein the body defines a ball.

3. The dissolvable tool of claim 1, wherein a cross sectional area of the at least one perforation is selected to control the rate of intrusion of the environment.

4. The dissolvable tool of claim 1, wherein a depth of the at least one perforation is selected to control the rate of intrusion of the environment.

5. The dissolvable tool of claim 1, wherein the at least one perforation is dimensioned to control surface area of the dissolvable tool exposed to the environment.

6. The dissolvable tool of claim 1, wherein the environment includes a chemical.

7. The dissolvable tool of claim 1, wherein the environment includes brine.

8. The dissolvable tool of claim 1, wherein the environment includes changes in temperature and pressure.

9. The dissolvable tool of claim 1, wherein the body includes a shell that defines the surface being made of a first material and the shell surrounds a core made of a second material.

10. The dissolvable tool of claim 9, wherein the shell is configured to fracture under loads experienced during use when not supported by the core.

11. The dissolvable tool of claim 9, wherein the second material is more reactive to the environment than the first material.

12. The dissolvable tool of claim 9, wherein the core provides structural support to the shell that reduces as the core reacts with the environment.

13. The dissolvable tool of claim 1, further comprising at least one plug positioned within the at least one perforation.

14. The dissolvable tool of claim 13, wherein the at least one plug is made of a different material than a balance of the body.

15. The dissolvable tool of claim 13, wherein the at least one plug is porous.

16. The dissolvable tool of claim 1, wherein the dispersed particles comprise Mg—Zn, Mg—Zn, Mg—Al, Mg—Mn, Mg—Zn—Y, Mg—Al—Si or Mg—Al—Zn.

17. The dissolvable tool of claim 1, wherein the dispersed particles have an average particle size of about 5 μm to about 300 μm.

18. The dissolvable tool of claim 1. wherein the dispersed particles have an equiaxed particle shape.

19. The dissolvable tool of claim 1, wherein the nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials, and wherein the nanomatrix material has a chemical composition and the particle core material has a chemical composition that is different than the chemical composition of the nanomatrix material.

20. The dissolvable tool of claim 1, wherein the cellular nanomatrix has an average thickness of about 50 nm to about 5000 nm.

* * * * *